US008511118B2

(12) United States Patent
Lai et al.

(10) Patent No.: US 8,511,118 B2
(45) **Date of Patent: *Aug. 20, 2013**

(54) HIGH SECURITY, DUAL-MODE PADLOCK CONSTRUCTION

(75) Inventors: Eric Lai, Tai Po (HK); Karl Lai, Tai Po (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 762 days.

This patent is subject to a terminal disclaimer.

(21) Appl. No.: 12/653,806

(22) Filed: Dec. 21, 2009

(65) Prior Publication Data

US 2010/0095718 A1 Apr. 22, 2010

Related U.S. Application Data

(63) Continuation-in-part of application No. 12/220,771, filed on Jul. 28, 2008.

(60) Provisional application No. 60/964,646, filed on Aug. 14, 2007.

(51) Int. Cl.
*E05B 37/00* (2006.01)

(52) U.S. Cl.
USPC ..... 70/21; 70/284; 70/285

(58) Field of Classification Search
USPC ..... 70/20, 21, 24–26, 38 A, 38 C, 38 R, 70/39, 284, 285
See application file for complete search history.

(56) References Cited

U.S. PATENT DOCUMENTS

| | | | | |
|---|---|---|---|---|
| 1,001,104 | A * | 8/1911 | Wayda | 70/21 |
| 1,897,922 | A * | 2/1933 | Bradshaw | 70/26 |
| 2,378,768 | A * | 6/1945 | Heyer | 70/21 |
| 3,349,584 | A * | 10/1967 | Russell et al. | 70/21 |
| 3,472,049 | A * | 10/1969 | Sewell | 70/21 |
| 5,953,940 | A * | 9/1999 | Ling | 70/25 |
| 7,117,698 | B2 * | 10/2006 | Lai | 70/21 |
| 7,370,498 | B1 * | 5/2008 | Miao | 70/21 |
| 7,523,628 | B2 * | 4/2009 | Yu | 70/21 |
| 7,562,545 | B2 * | 7/2009 | Lai et al. | 70/21 |

* cited by examiner

*Primary Examiner* — Christopher Boswell

(57) ABSTRACT

By employing a deadbolt construction for virtually eliminating the ability of the shackle to be removed from the housing by the application of excessive force, an effective, easily produced, padlock is achieved which also incorporates two separate and independent locking systems formed in a single padlock. In the present invention, a single housing and a single shackle assembly are employed and are constructed for enabling the shackle to be released from locked engagement with the housing using either a rotatable dial combination construction or a key activated tumbler construction. Furthermore, the rotatable combination defining dials, which controls the release of the shackle using the preset combination, are coaxially aligned, peripherally surrounding the key controlled tumbler/cylinder. As a result, a compact construction is realized, as well as an efficient and effective release construction which is shared by both the combination controlled section as well as the key controlled section.

18 Claims, 36 Drawing Sheets

76 (BEFORE RIVETED)

76 (AFTER RIVETED)

HIGH SECURITY, DUAL-MODE PADLOCK CONSTRUCTION

RELATED DATA

This application is a continuation-in-part patent application of U.S. Ser. No. 12/220,771, filed Jul. 28, 2008 entitled HIGH SECURITY, DUAL MODE PADLOCK CONSTRUCTION which is claims the benefit of U.S. Provisional Patent Application Ser. No. 60/964,646, filed Aug. 14, 2007 entitled HIGH SECURITY, DUAL MODE PADLOCK CONSTRUCTION.

TECHNICAL FIELD

This invention relates to padlocks and lock systems and, more particularly, to padlocks constructed to provide two separate an independent modes by which the padlock can be opened and closed in a high security system.

BACKGROUND ART

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence. Although locks of this general nature have been available for several decades, these prior art combination lock constructions suffer from common deficiencies which have not been successfully overcome.

Although many manufacturers have attempted to solve the problems associated with rotatable dial or combination locks, one principal difficulty and drawback these prior art constructions have been unable to overcome is a construction which is resistant to unwanted opening or breakage. In this regard, these prior art rotatable dial or combination locks are constructed in a manner which enables unauthorized individuals desiring to gain access to the lock item or area to open the padlock by merely applying the force to the locked shackle. Due to the typical construction of these prior art padlocks, these padlocks do not possess any substantial resistance to the application of a pulling force when applied to the shackle in an attempt to withdraw the shackle from the housing. As a result, the application of such a pulling force causes the shackle to become disengaged from the housing, enabling access to the item or area to be attained.

In addition, it has been found that many of these prior art padlocks are employed by individuals to secure their luggage or suitcases during travel. In this regard, in airplane travel, new regulations and requirements allow customs officers or transit security personnel to physically break any padlock in order to gain access to luggage which is deemed suspicious. Under these new security regulations, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any padlock which may be on the luggage.

With these new regulations presently implemented, all prior art systems which are incapable of being opened by inspectors and/or security personnel are subject to being physically broken, in order to gain access to any luggage which needs to be visually inspected. As a result, consumers are faced with the possibility that any like system employed to protect the contents of the suitcase can be physically removed by security personnel, leaving the luggage completely unprotected during the remainder of the trip.

In order to eliminate the possibility of having a padlock completely broken by security personnel, newer prior art padlocks have been constructed with two separate and independent locking systems formed in a single padlock, with both locking systems independently enabling a single shackle to be released and/or lockingly engaged. In this way, by employing either a key activation zone or a combination activation zone, the padlock can be opened. Furthermore, padlocks of this general construction employ key controlled constructions which are open using master keys which are in the possession of security personnel. In this way, security personnel are able to open these padlocks for inspecting the contents of the luggage, and then re-lock the padlock in place after the inspection has been completed.

Although these dual locking prior art padlocks have generally resolved the difficulty encountered with transit security personnel inspecting luggage, the continuing problem of padlocks being easily broken by unauthorized individuals by merely forcing the shackle to separate from the housing has not been addressed. In addition, another problem that has recently developed is a requirement that all padlocks should be capable of automatically relocking after being opened by the master key. In this way, valuable time is saved for the security personnel by eliminating the need for the padlock to be re-lock in place using the master key.

In addition, another problem area and drawback which prior art constructions have been unable to overcome is a construction which assures the user that a preset combination will not be accidentally or inadvertently altered or changed, without the user's knowledge. In such instances when the known combination is unknowingly changed or altered without the user's knowledge, the entire combination lock is incapable of future use, since the user is typically unable to release the shackle from locked engagement with the housing.

Another common problem which has consistently plagued prior art constructions is the cost of construction for producing and assembling prior art padlocks, whether the padlock is key operated, combination operated, or dual. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

Another problem commonly found with prior art padlocks is the inability of these prior art constructions to prevent contaminants from reaching the rotatable, internal component of the lock, thereby causing damage to these components or interfering with the ease of operating the lock by an individual who either knows the actual combination or has the activating key. Although numerous attempts have been made to reduce the adverse effects caused by contaminants reaching these components, such attempts have been incapable of completely eliminating in this problem.

Therefore, it is a principal object of the present invention to provide a padlock construction which is specifically designed for effective operation in high security applications.

Another object of the present invention is to provide a high security padlock construction having the characteristic features described above which virtually eliminates the ability of unauthorized persons from gaining access to the lock by attempting to pick the lock, using known techniques, or open the lock by force.

Another object of the present invention is to provide a high security padlock construction having the characteristic features described above which employs a minimum of components and is quickly and easily assembled, thereby providing a lock capable of being constructed at a competitive price.

Another object to the present invention is to provide a high security padlock having the characteristic features described above which effectively seals the rotating components from external contamination and effectively prevents any external contaminants from reaching the rotating components and thereof.

Other and more specific object will in part be obvious and will in part appear hereinafter.

SUMMARY OF THE INVENTION

By employing the present invention, all of the difficulties and drawbacks of the prior art constructions are virtually eliminated and an effective, easily produced, padlock is achieved which incorporates two separate and independent locking systems formed in a single padlock, with both locking systems independently enabling the single shackle to be released and/or lockingly engaged. Furthermore, the padlock of the present invention is constructed employing a unique combination of components which effectively achieves a deadbolt construction, thereby virtually eliminating the ability of the shackle to be removed from the housing by the application of excessive force. As a result, the padlock of the present invention can be opened using either a pre-designated key or a predetermined or preset combination. However, the padlock is virtually incapable of being opened by unauthorized personnel attempting to extract the shackle from the housing excessive force.

In accordance with the present invention, a single housing and a single shackle assembly are employed and constructed for enabling the shackle to be released from locked engagement with the housing either a rotatable dial combination construction or a key activated tumbler construction. In this way, a dual locking and releasing padlock is achieved which virtually eliminates the difficulties typically encountered with known prior art lock configurations.

Furthermore, in the preferred embodiment of the present invention, a generally conventional J-shaped shackle is employed with one portion of the housing cooperatively associated with the longer leg of the shackle. In addition, this portion of the shackle is cooperatively associated with a dead bolt locking system for effectively integrating the shackle with the housing when in the locked position. As a result, removal of the shackle from the housing excessive force becomes virtually impossible.

In addition, the rotatable combination defining dials, which control the release of the shackle using the preset combination, are coaxially aligned, peripherally surrounding the key controlled tumbler/cylinder. As a result, a compact construction is realized, as well as an efficient and effective release construction which is shared by both the combination controlled section as well as the key controlled section.

Furthermore, in accordance with the present invention, a unique padlock construction configuration is employed for substantially reducing the components required in the padlock construction, as well as substantially eliminating the overall size required for the padlock. In this regard, in the preferred embodiment, the tumbler housing or cylinder required for providing the key controlled release of the shackle is positioned in coaxial alignment with the rotatable dials employed for providing the combination controlled release of the shackle.

In addition, the locking and unlocking cams, spindles, and clutches employed for locking and releasing the shackle are all aligned with each other and co-operate with each of the locking/unlocking components. In this way, by coaxially aligning both shackle controlling sections of the padlock, a compact, enhanced, and substantially improved construction is realized with both the cost of manufacture and component costs being dramatically reduced.

By employing the dual locking padlock construction of the present invention, all of the difficulties and drawbacks which travelers face under newly enacted regulations are completely overcome. As detailed above, recently enacted regulations empower customs officers and/or inspection and security personnel to physically break any secured lock on the suitcase in order to gain access to a suitcase which is believed to contain suspicious material. However, by employing the present invention, the possibility of having a lock completely broken by customs or security personnel is prevented.

In one embodiment, employing the locking mode padlock of the present invention, which comprises a combination controlled section and a key controlled section, a master key is created which is able to open the key controlled section of all dual mode padlocks. As a result, in the event that a customs officer or security personnel requires a particular piece of luggage to be opened for further visual inspection, the customs officer or security personnel is able to open the dual locking mode padlock by employing the master key which is provided to all such individuals. In this way, physically breaking a lock is totally eliminated and once a visual inspection has been completed the dual locking mode padlock would be replaced on the luggage and locked in position, in order to secure the contents in the luggage for the remainder of the trip.

Furthermore, an additional feature incorporated into the padlock of the present invention is the incorporation of a non-key-captive system in the locking portion of the padlock. By employing this construction, a security officer or inspector is able to release the shackle from the housing of the padlock using the master key and remove the key in order to do the desired inspection. Thereafter, when the luggage or suitcase is to be relocked, the shackle is reinserted into the housing and automatically locked in place, without requiring the use of the master key. As a result, a security officer or inspector is able to save a substantial amount of time and is more likely to securely affix the padlock to the suitcase for the benefit of the owner.

In an alternate embodiment, a single master key is required in order to reset the combination. In this way, the padlock can be employed for securing property, real estate, businesses, and the like which may be accessed by several different individuals. Therefore, various individuals can be given a single combination for enabling the padlock to be opened, while preventing any individual from resetting the combination without authority, thereby preventing other individuals from gaining access to the particular location. In this embodiment, only the owner of the particular property, business, etc. is able to reset the combination using the master key.

In addition, the padlocks of the present invention are constructed with the interior chamber virtually sealed from the ambient surroundings, thereby preventing unwanted contamination from entering the interior of the padlock and the rotating component thereof. In this way, prior art degradation and interference of the locked operation by contamination is virtually eliminated.

In accordance with the present invention, a minimum number of components are employed in combination with the housing and the movable shackle, in order to provide the desired unique, dual mode padlock construction of the present invention. In addition to the shackle and housing, only the plurality of rotating dials, plurality of tumbler sleeves, key operated tumblers and rotatable chambers are required to provide the dual mode padlock construction of this invention, along with the dead bolt shackle engaging components which are constructed for cooperating with both the key operated section and the combination controlled section.

In addition to the principal elements detailed above, the present invention achieves a dual-mode padlock using a minimum number of independent components, each of which is capable of being quickly assembled into the final product. As a result, a construction is achieved which is capable of being manufactured at competitive prices, while providing a high quality, highly effective, high security dual-mode padlock which virtually eliminates any degradation due to exposure to environmental contaminants, while also preventing unwanted access from being achieved by application of excessive force.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

Figure 41:
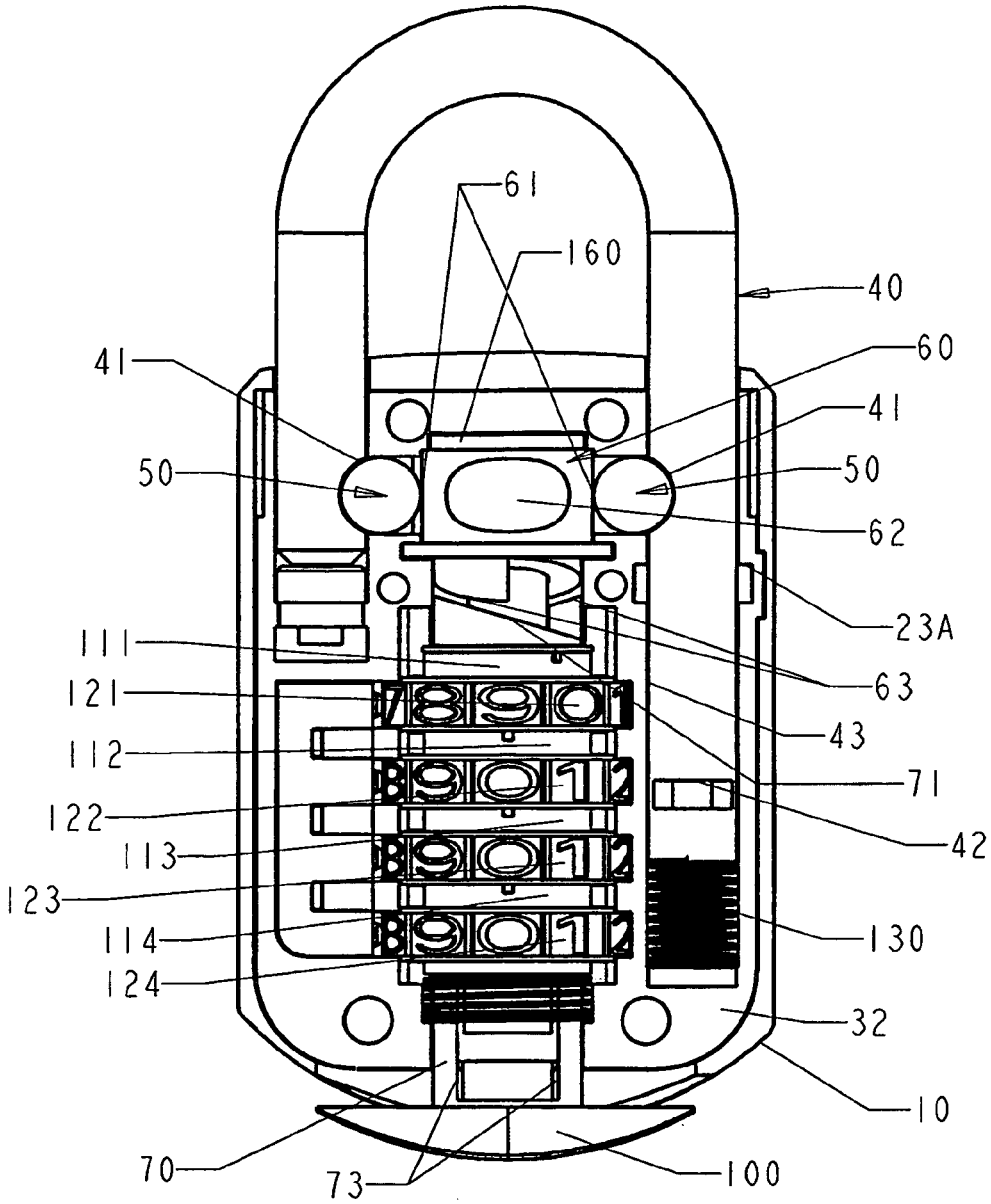
FIG. 41 is a front elevation view of a further alternate embodiment of the high security, dual-mode padlock of the present invention, shown fully assembled with one portion of the housing removed.
Figure 41A:
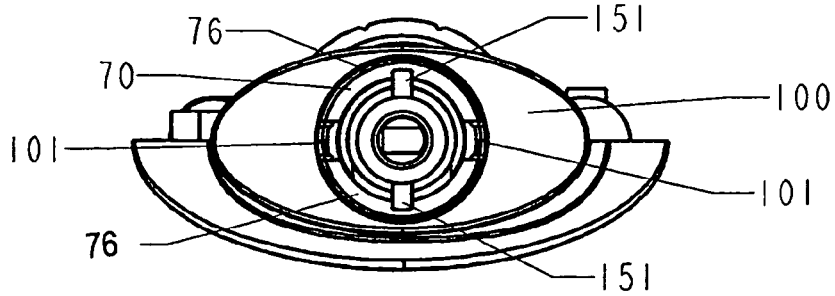
Figure 42:
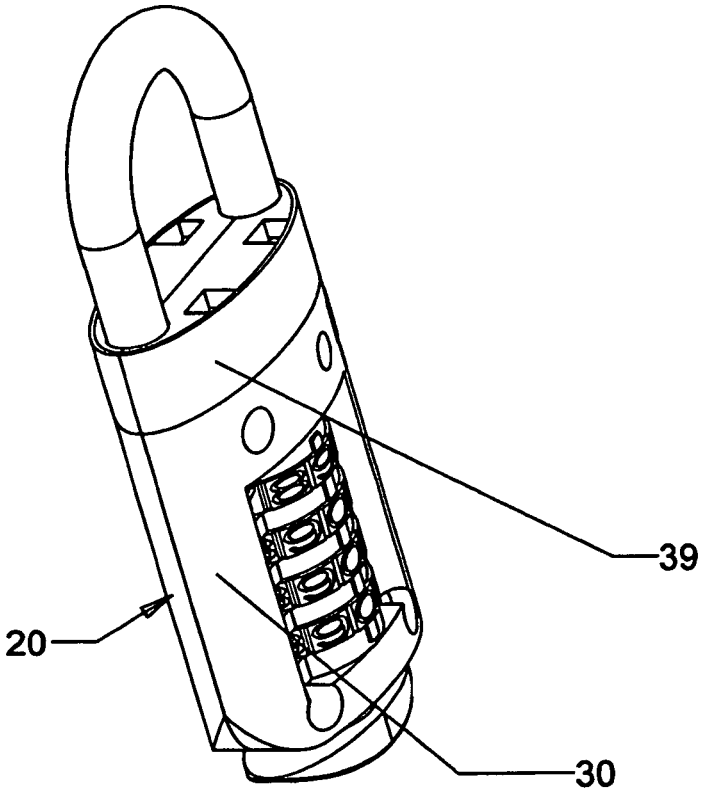
Figure 43:
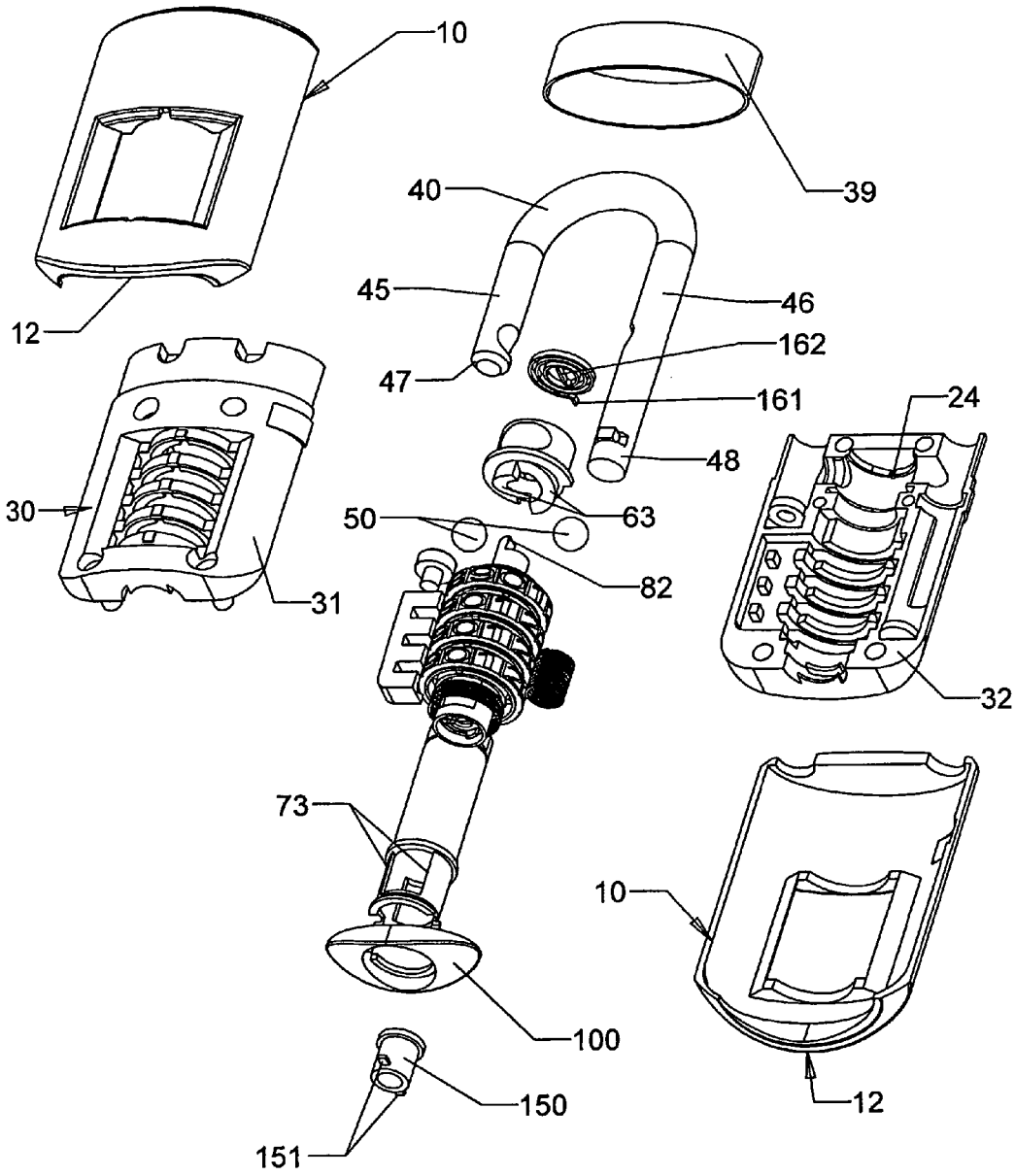
Figure 44A:
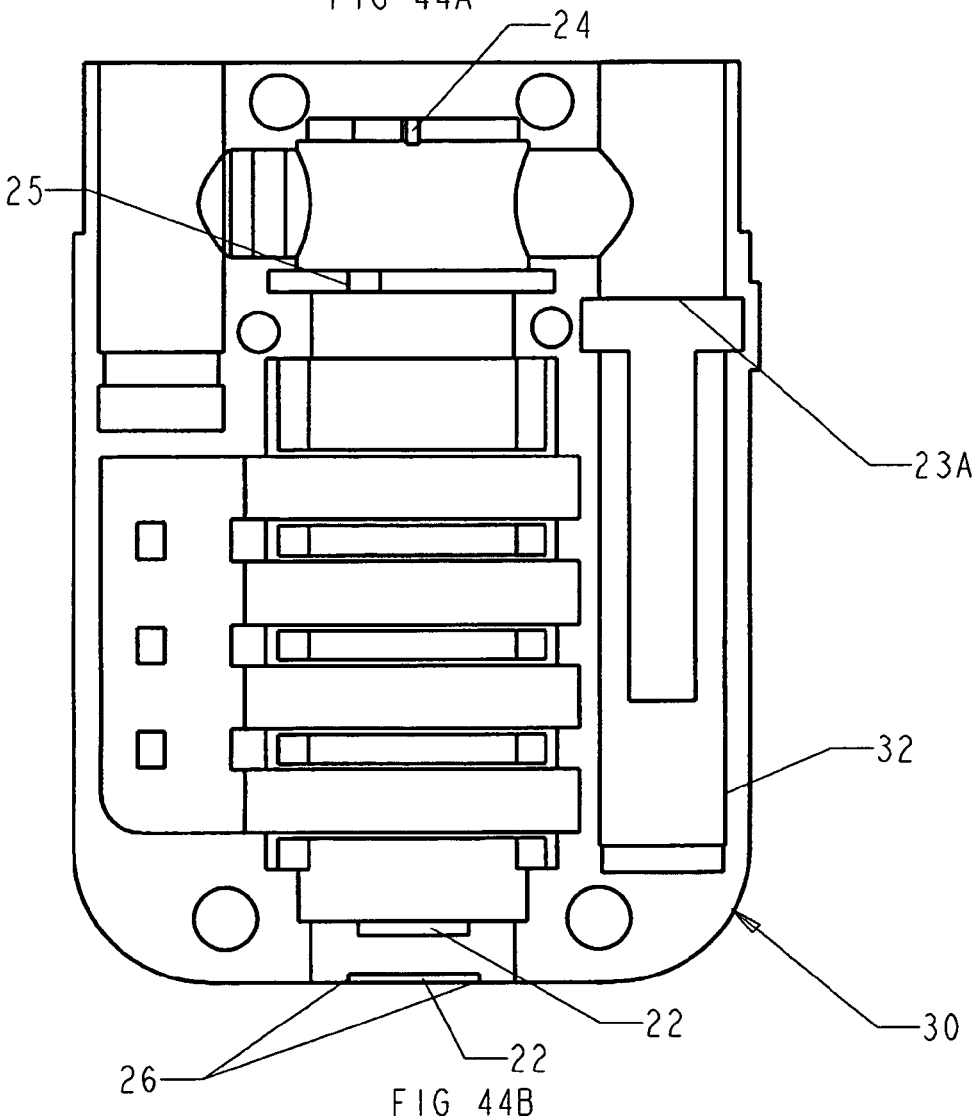
Figure 44B:
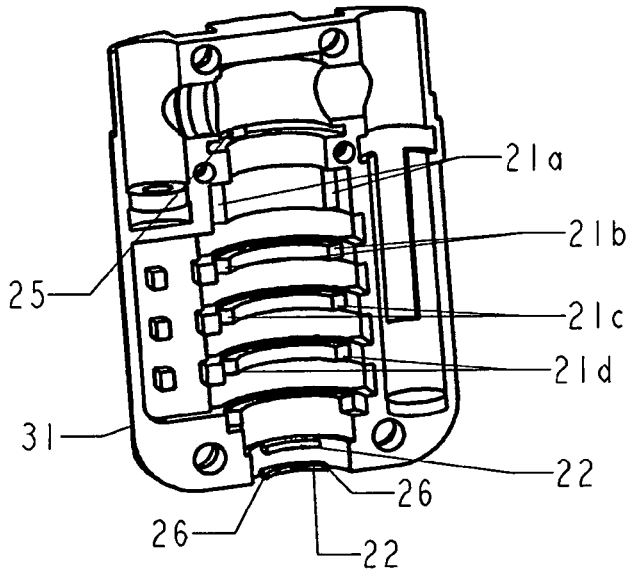
Figure 45B:
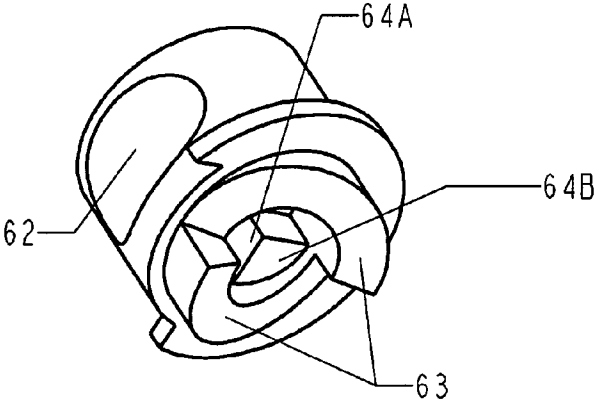
Figure 45D:
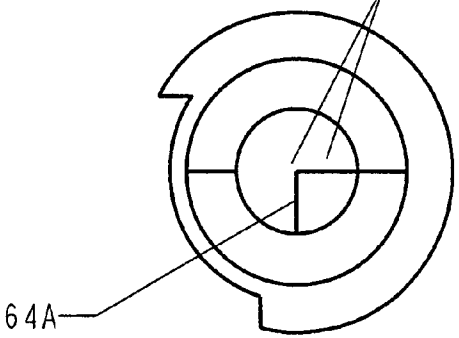
Figure 45A:
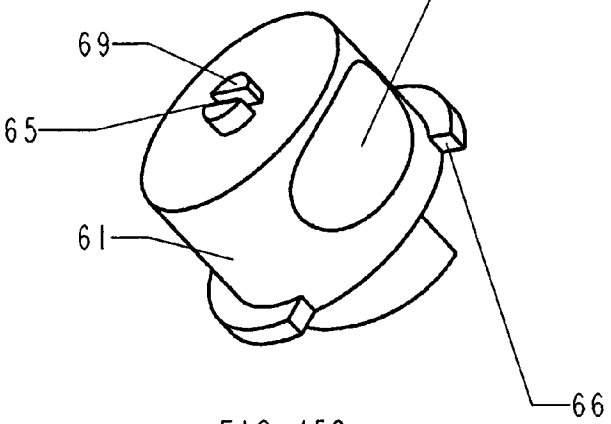
Figure 45C:
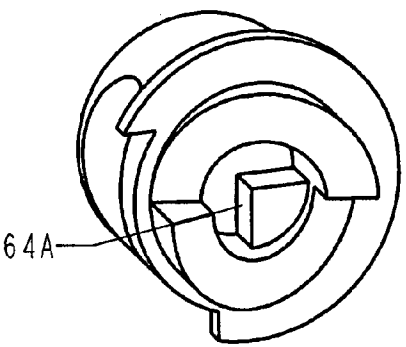
Figure 46A:
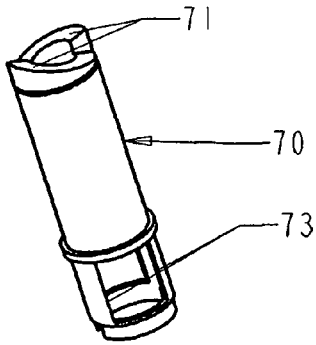
Figure 46B:
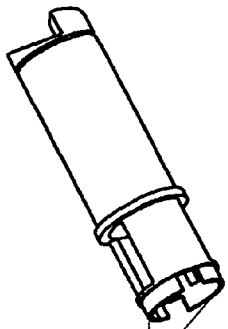
Figure 46C:
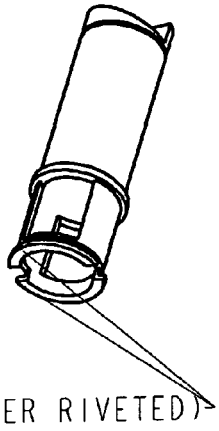
Figure 47A:
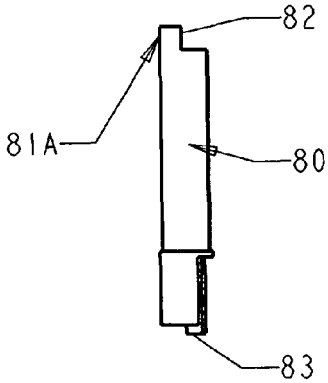
Figure 47B:
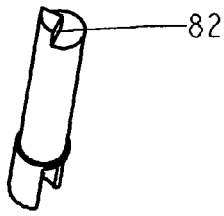
Figure 48:
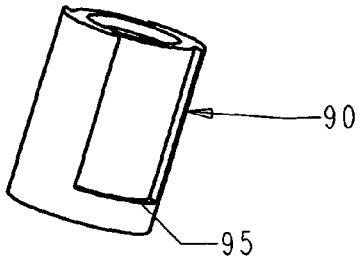
Figure 49A:
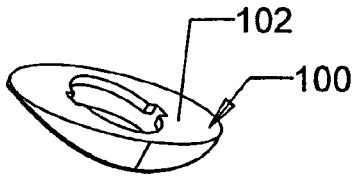
Figure 49B:
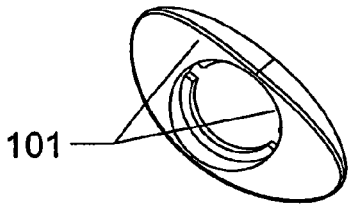
Figure 50A:
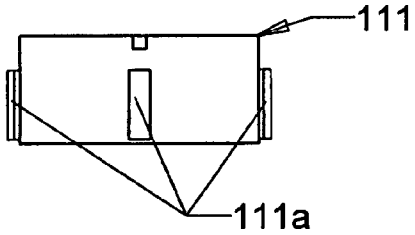
Figure 49C:
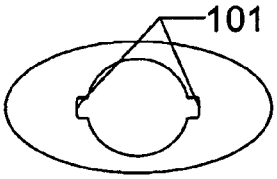
Figure 50B:
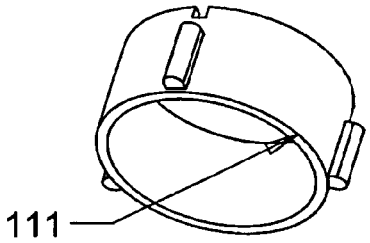
Figure 51A:
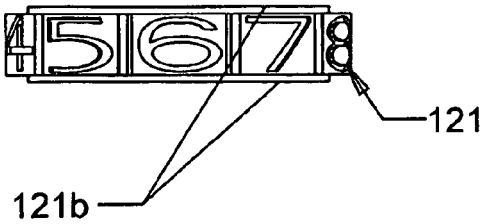
Figure 51B:
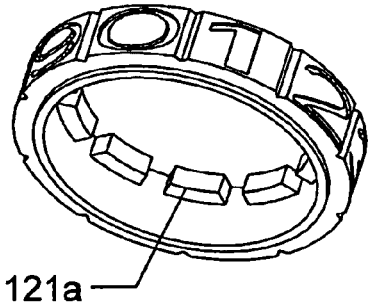
Figure 52A:
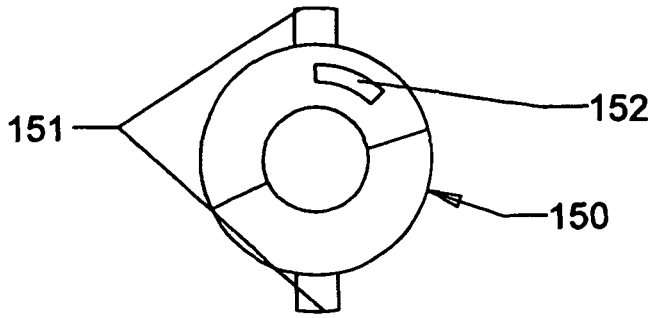
Figure 52B:
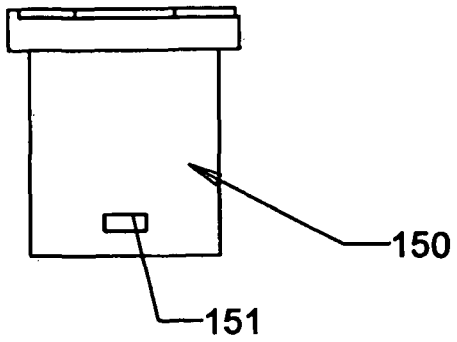
Figure 53:
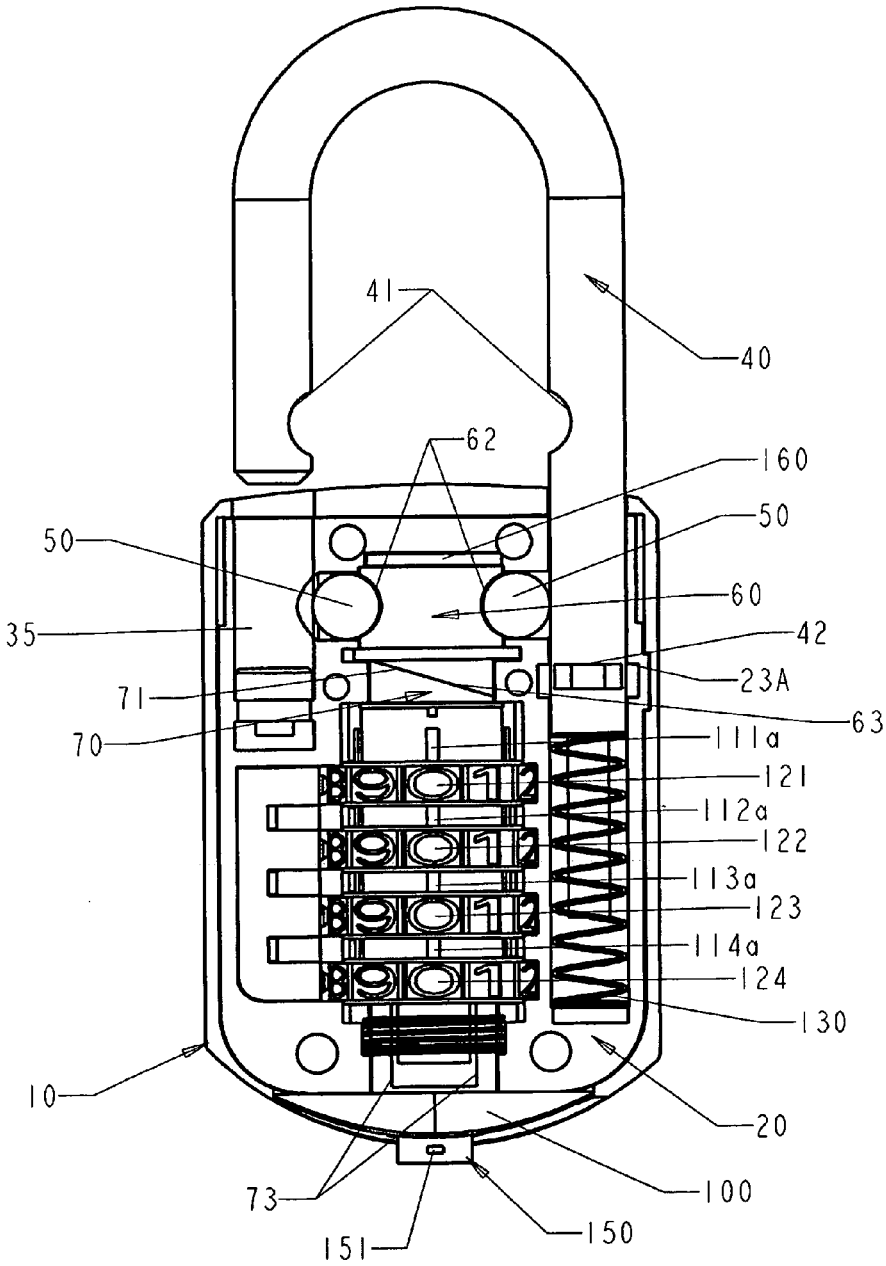
Figure 54:
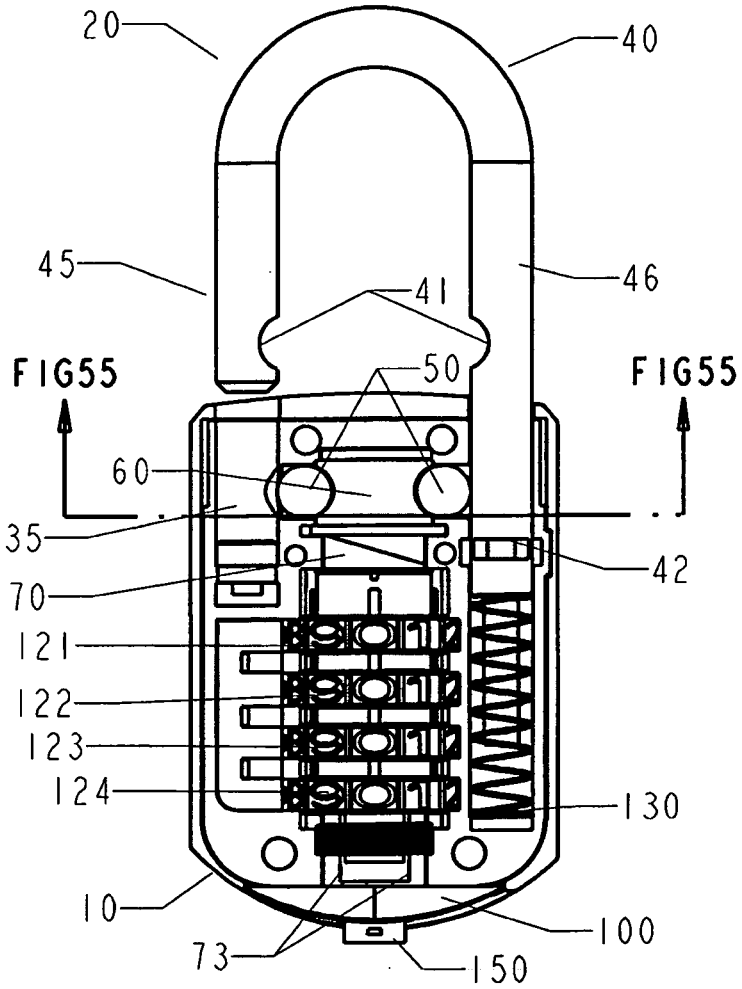
Figure 55:
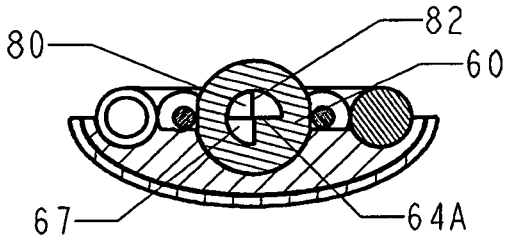
Figure 56A:
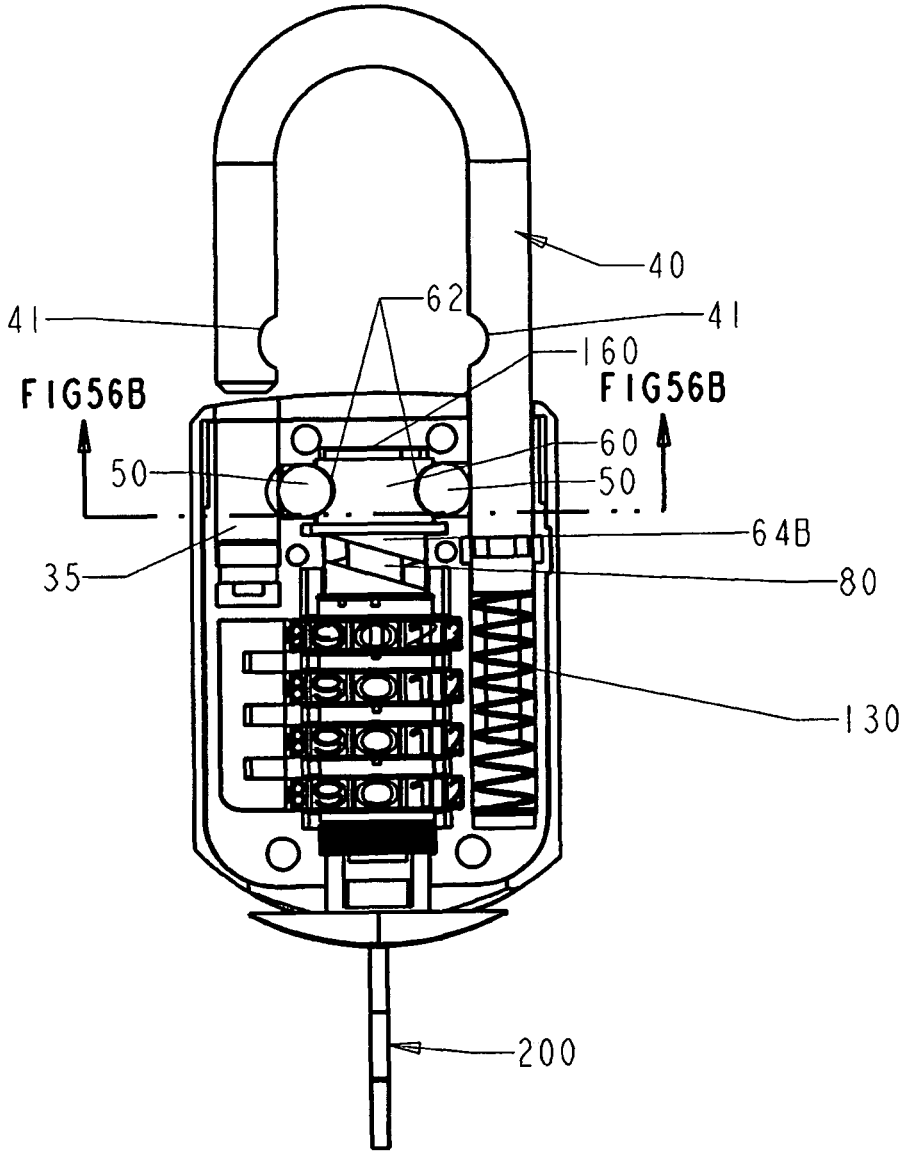
Figure 56B:
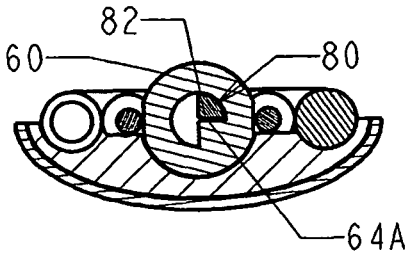
Figure 57:
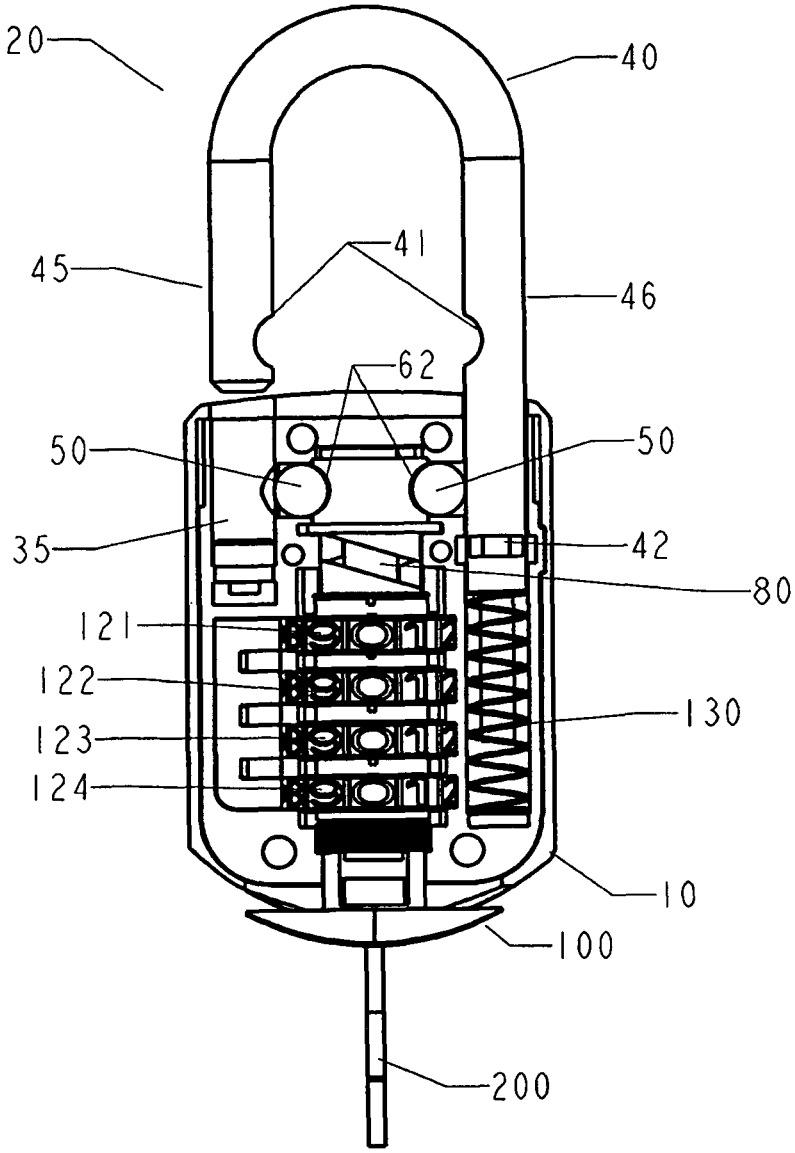
Figure 58:
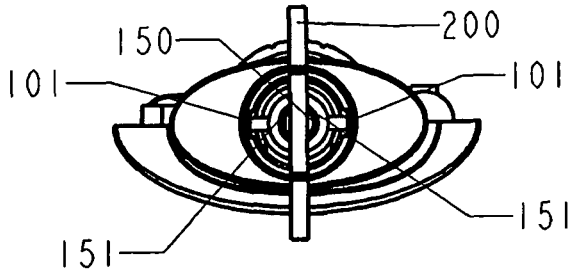
Figure 60:
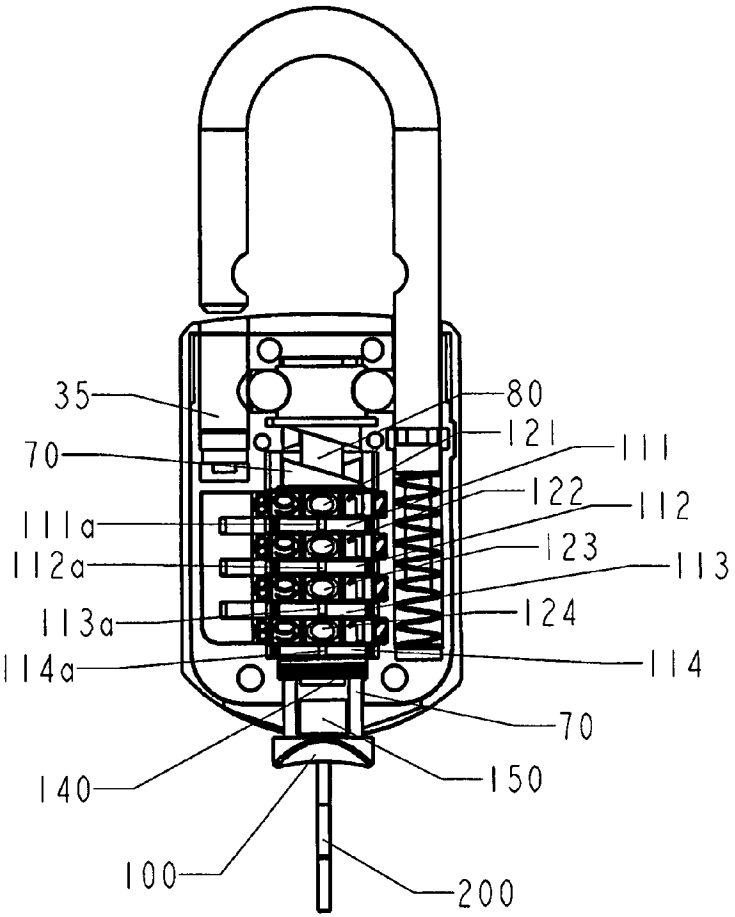
Figure 59:
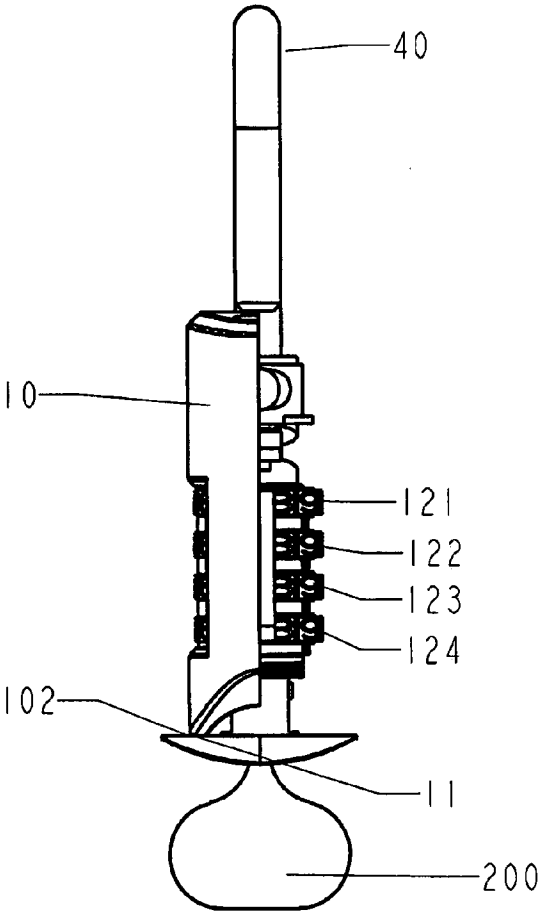
Figure 61:
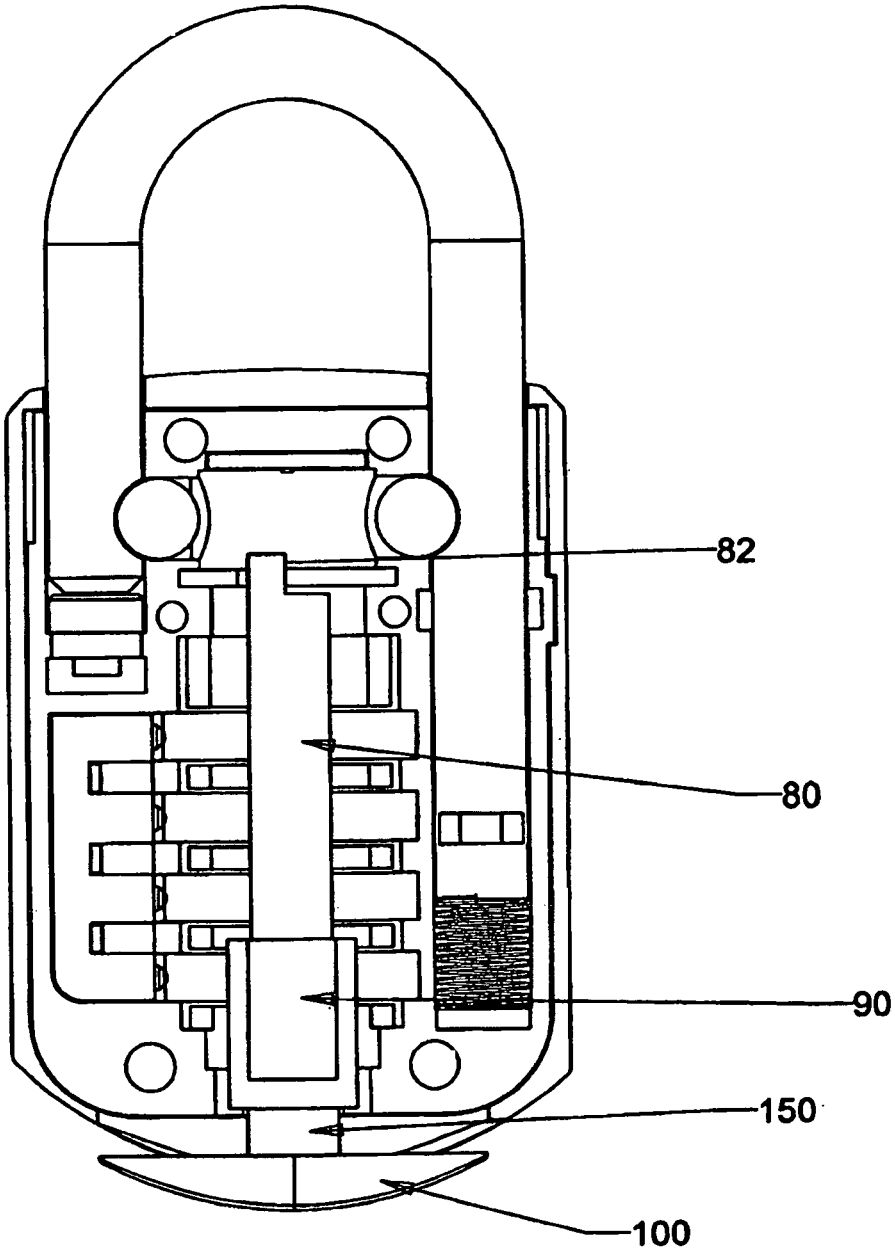
Figure 62:
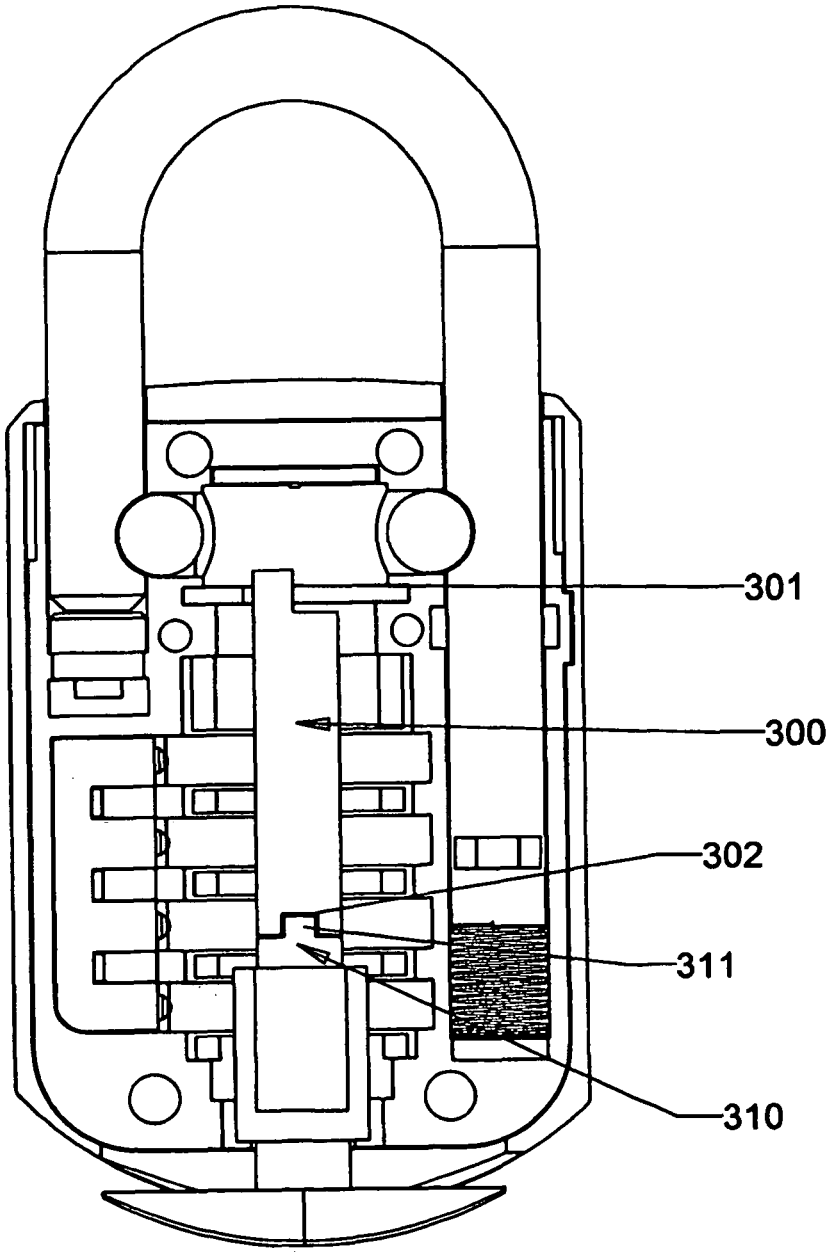

FIG. 41*a* is a bottom plan view of the high security, dual-mode padlock of FIG. 41;

FIG. 42 is a perspective view of the high-security, dual-mode padlock of FIG. 41 shown fully assembled;

FIG. 43 is an exploded perspective view of the high-security, dual-mode padlock of FIG. 41;

FIG. 44A is a front elevation view of one section of the housing employed in forming high-security, dual-mode padlock of FIG. 41;

FIG. 44B is a rear perspective view of the second section of the housing employed in forming high-security, dual-mode padlock of FIG. 41;

FIGS. 45A, 45B, and 45C are alternate perspective views of the cam/control member forming a component of the high-security, dual-mode padlock of FIG. 41;

FIG. 45D is a bottom plan view of the cam/control member of high-security, dual-mode padlock of FIG. 41;

FIGS. 46A, 46B, and 46C are alternate perspective views of the spindle/sleeve which forms a component of the high-security, dual-mode padlock of FIG. 41;

FIGS. 47A and 47B are perspective views of the cylinder which forms a component of the high-security dual-mode padlock of FIG. 41;

FIG. 48 is a perspective view of a component of the high security dual-mode padlock of FIG. 41;

FIGS. 49A and 49B are perspective views depicting the activation button employed in the high-security, dual mode padlock of FIG. 41;

FIG. 49C is a bottom plan view of the activation button employed in the high-security, dual-mode padlock of FIG. 41;

FIG. 50A is a side elevation view of the clutch which forms a component of the high-security, dual-mode padlock of FIG. 41;

FIG. 50B is a perspective view of the clutch of FIG. 50A;

FIG. 51A is a side elevation view of the rotatable dial forming a component of the high-security, dual-mode padlock of FIG. 41;

FIG. 51B is a perspective view of the rotatable dial of FIG. 51A;

FIG. 52A is a bottom plan view of the blocking member which forms a component of the high-security dual-mode padlock of FIG. 41;

FIG. 52B is a side elevation view of the blocking member of FIG. 52A;

FIGS. 53 and 54 are front elevation views of the high-security dual-mode padlock of FIG. 41 shown in the open position;

FIG. 55 is a cross-sectional interior view of the high-security, dual-mode padlock of FIG. 54 taken long line 55-55 thereof;

FIG. 56A is a front elevation view of the high-security dual-mode padlock of FIG. 41 shown in the open position after being released by use of an activation key;

FIG. 56B is a cross-sectional interior view of the high-security, dual-mode padlock of FIG. 56A taken long line 56B-56B;

FIG. 57 is a front elevation view of the high-security, dual-mode padlock of FIG. 41 shown in the open position by employing the activation key;

FIG. 58 is a bottom plan view of the high-security, dual-mode padlock of FIGURE of 57;

FIG. 59 is a side elevation view of the high-security, dual-mode padlock of FIG. 57 shown in the reset mode;

FIG. 60 is a front elevation view of the high-security, dual-mode padlock of FIG. 57 shown in the reset mode;

FIG. 61 is a front elevation view of the high-security, dual-mode padlock of FIG. 41 after being disengaged from the reset mode; and FIG. 62 is a front elevation view of an alternate embodiment of the high-security dual-mode padlock of FIG. 41.

DETAILED DISCLOSURE

Figure 1:
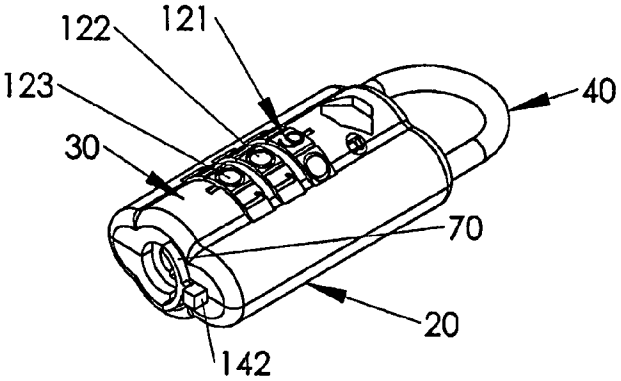
FIGS. 1 and 2 are perspective views of the high-security, dual-mode padlock of the present invention shown fully assembled and in the locked position.
Figure 2:
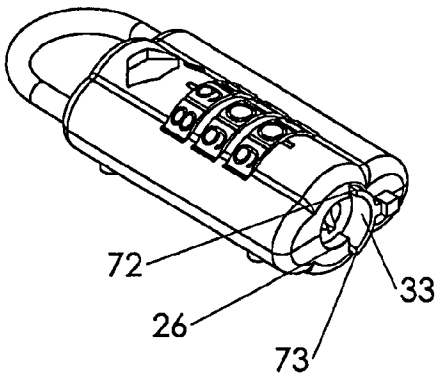
Figure 3:
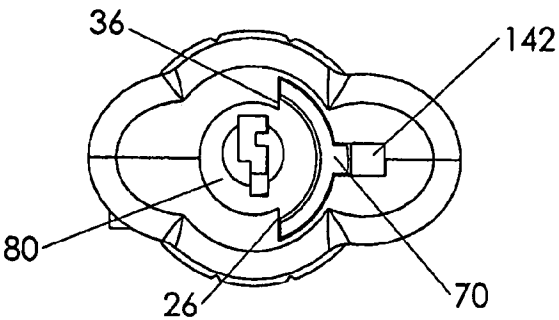
FIG. 3 is a bottom view of the high-security, dual-mode padlock of FIGS. 1 and 2.
Figure 4:
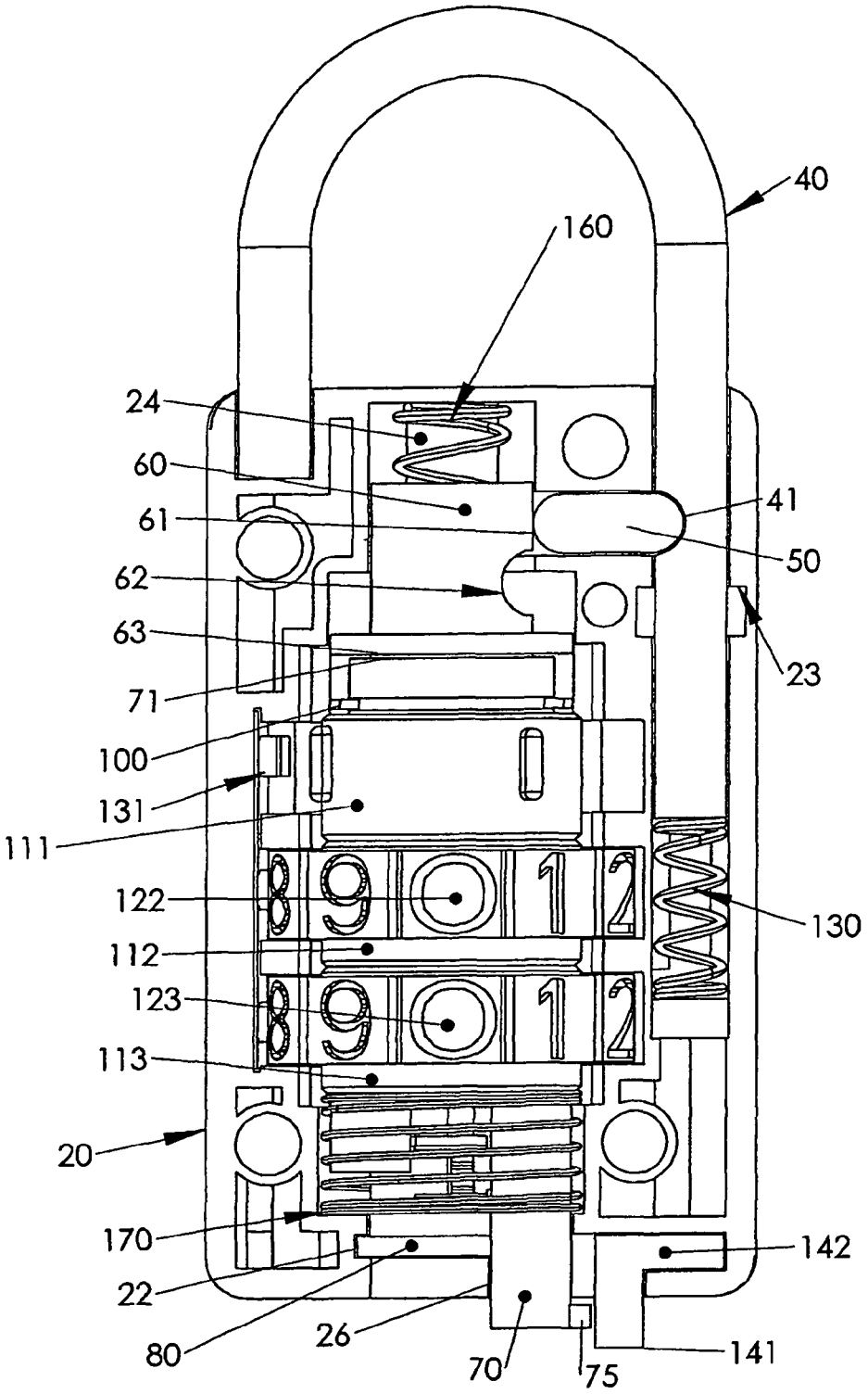
FIG. 4 is a cross-sectional side elevation view of the high-security, dual-mode padlock of FIGS. 1 and 2 shown fully assembled with one portion of the housing removed.
Figure 5A:
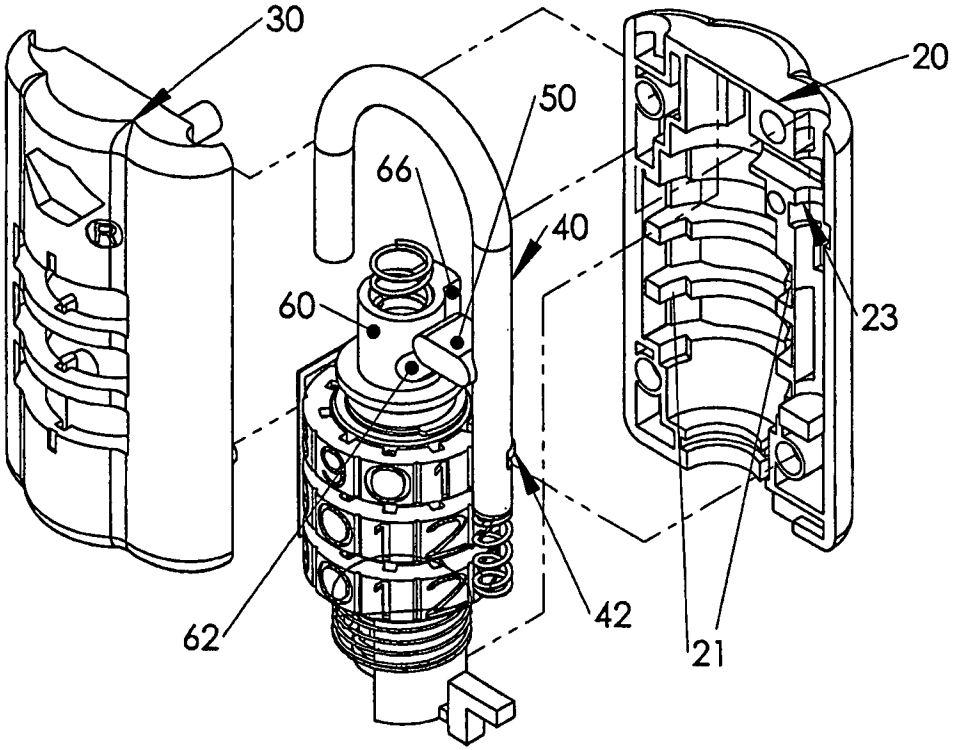
FIG. 5A is an exploded a perspective view of the fully assembled a high-security, dual-mode padlock of the present invention.
Figure 5B:
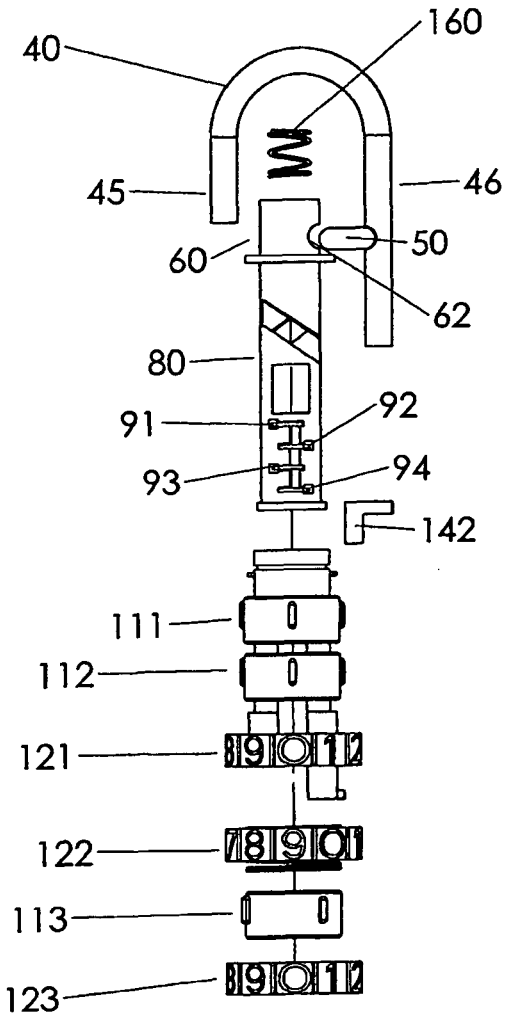
FIGS. 5B and 5C are exploded perspective views of the high-security, dual-mode padlock of the present invention with the housing removed.
Figure 5C:
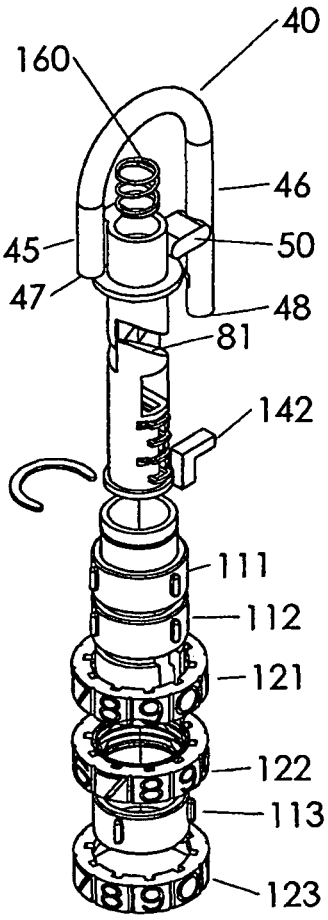
Figure 9:
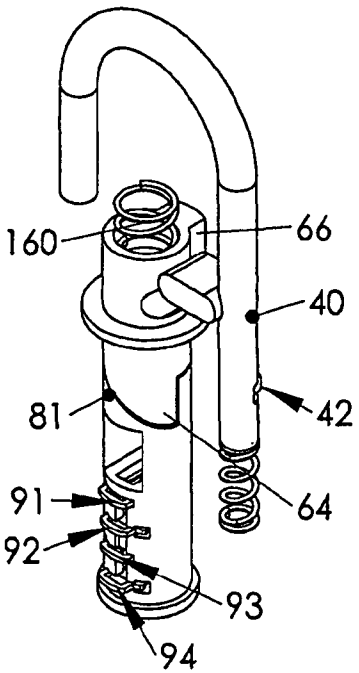
FIG. 9 is a perspective view of the high-security, dual-mode padlock of the present invention shown partially assembled.
Figure 8:
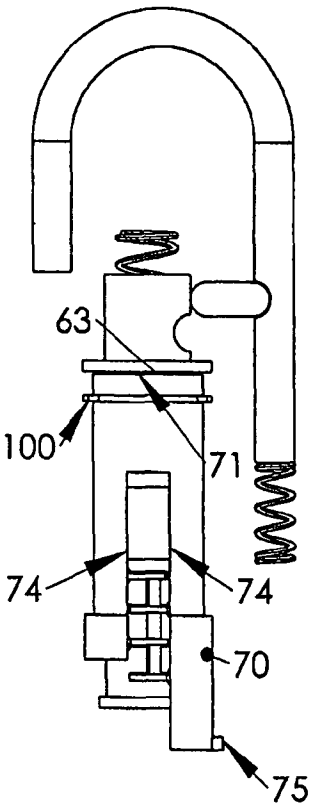
FIGS. 7 and 8 are side elevation views of the high-security, dual-mode padlock of the present invention shown partially assembled.
Figure 7:
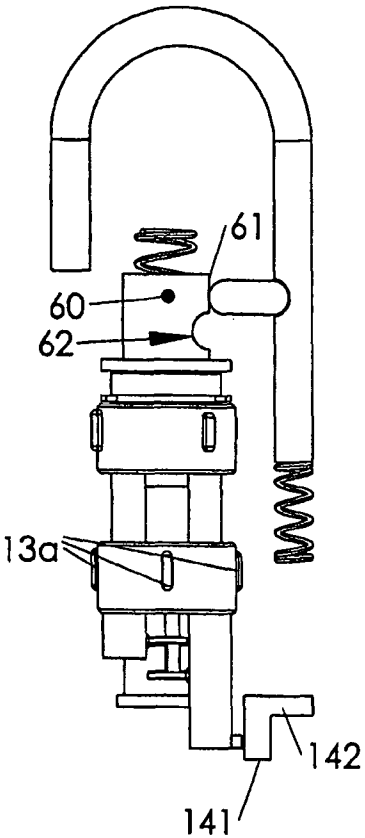
Figure 6:
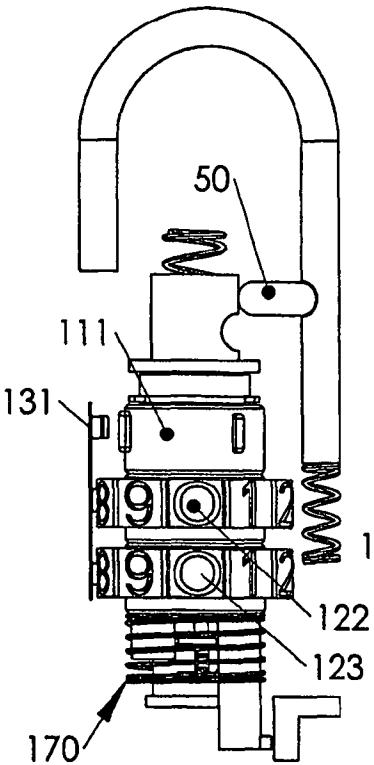
FIG. 6 is a side elevation view of the high-security, dual-mode padlock of the present invention with the housing removed.
Figure 10A:
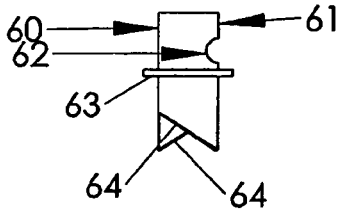
FIGS. 10A-13C are various views showing components incorporated into the high-security, dual-mode padlock of the present invention.
Figure 10B:
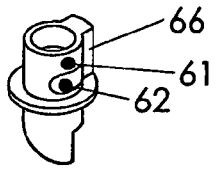
Figure 10C:
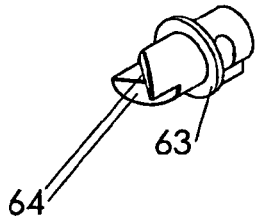
Figure 11A:
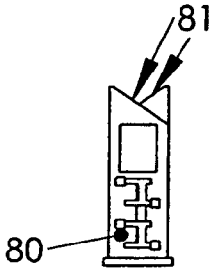
Figure 11B:
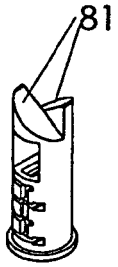
Figure 12:
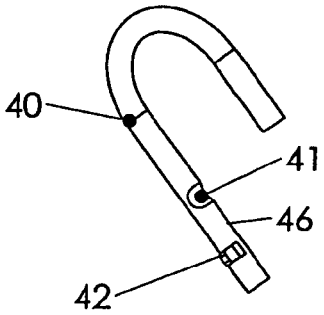
Figure 13A:
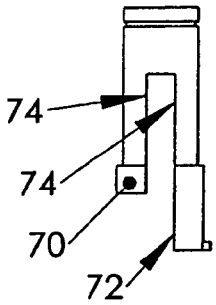
Figure 13B:
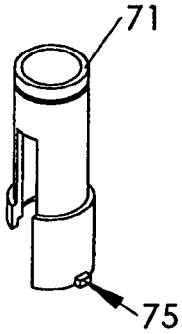
Figure 13C:
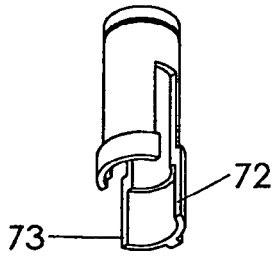
Figure 14:
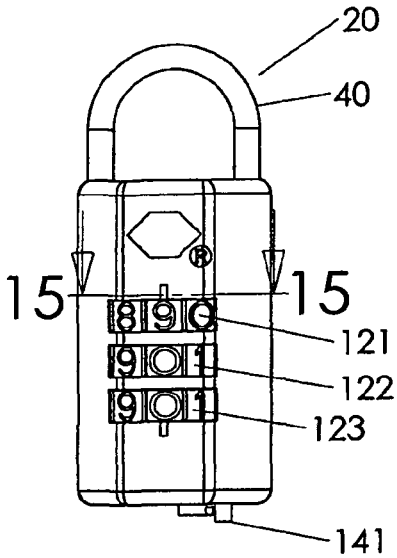
FIG. 14 is a front elevation view of the high-security, dual-mode padlock of the present invention shown fully assembled.
Figure 15:
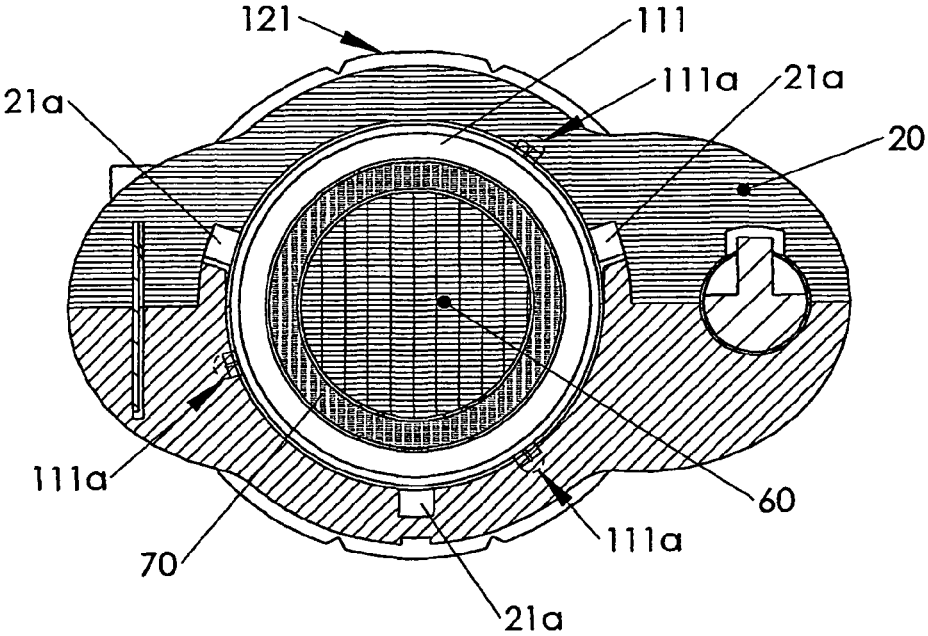
FIG. 15 is a cross-sectional view of the high-security, dual-mode padlock of the present invention taken along line 15-15 of FIG. 14.
Figure 16:
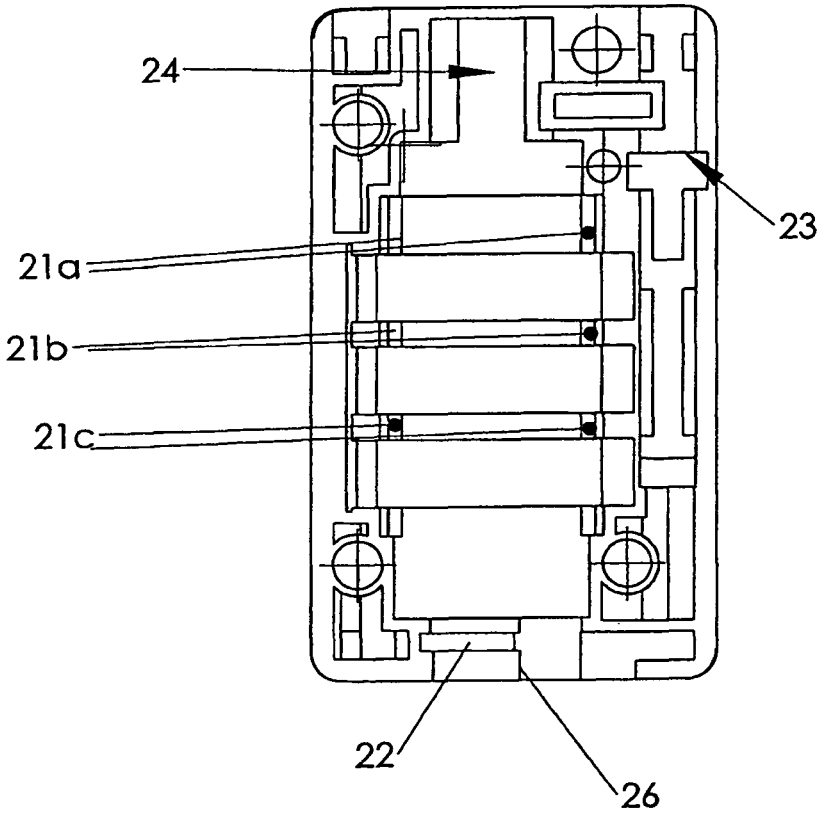
FIG. 16 is a side elevation view showing one housing component of the padlock of the present invention.
Figure 17:
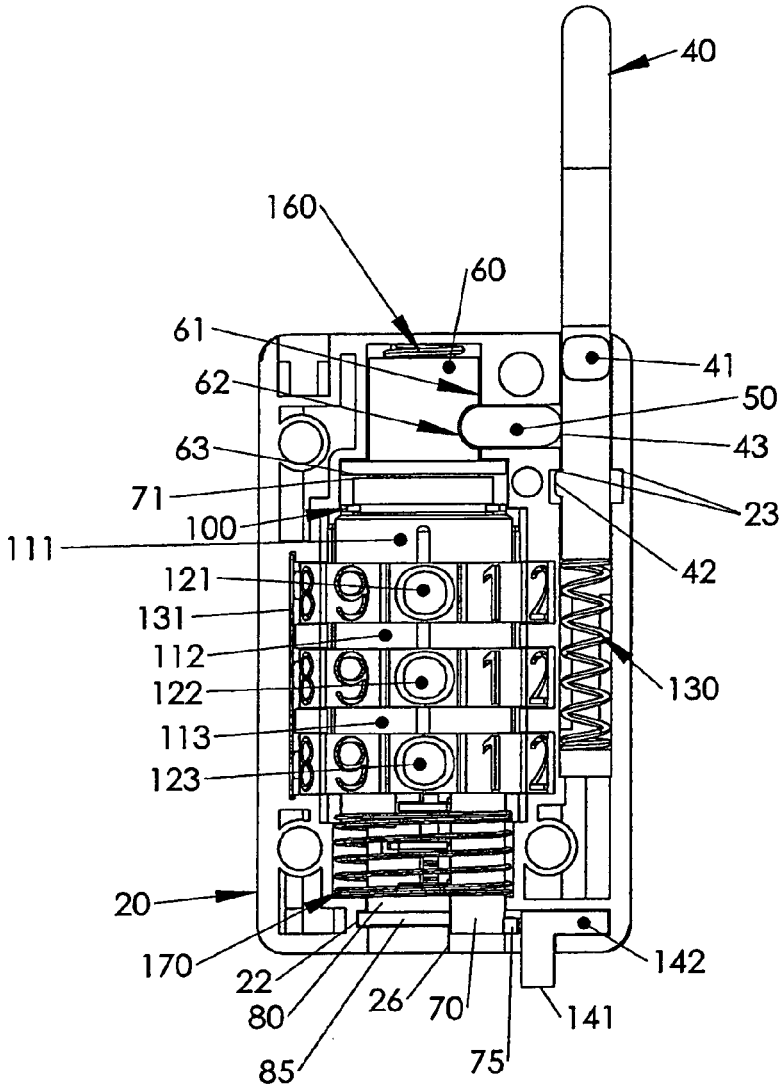
FIG. 17 is a side elevation view showing the high-security, dual-mode padlock of the present invention shown fully assembled and in the open position with one portion of the housing removed.
Figure 18:
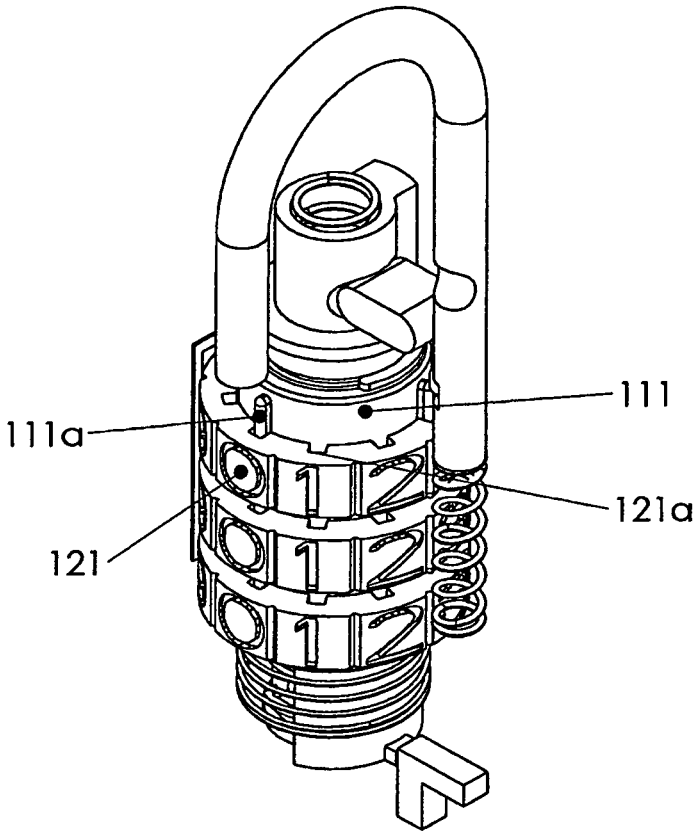
FIG. 18 is a perspective view of the high-security, dual-mode padlock of the present invention shown fully assembled with the housing removed therefrom.
Figure 19A:
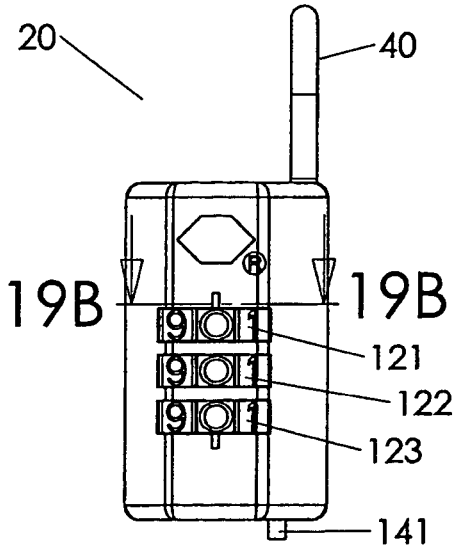
FIG. 19A is a front elevation view showing the high-security, dual-mode padlock of the present invention fully assembled and in the open position.
Figure 19B:
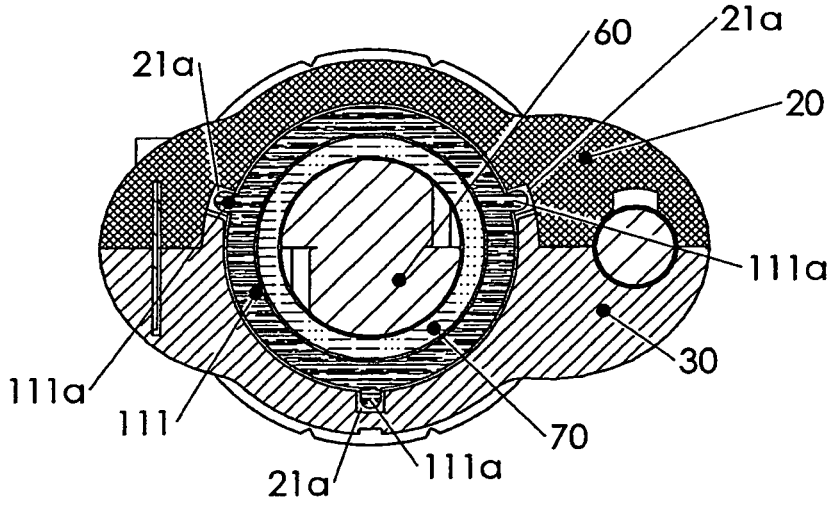
FIG. 19B is a cross-sectional of the high-security, dual-mode padlock taken along the line 19B-19B of FIG. 19A.
Figure 20:
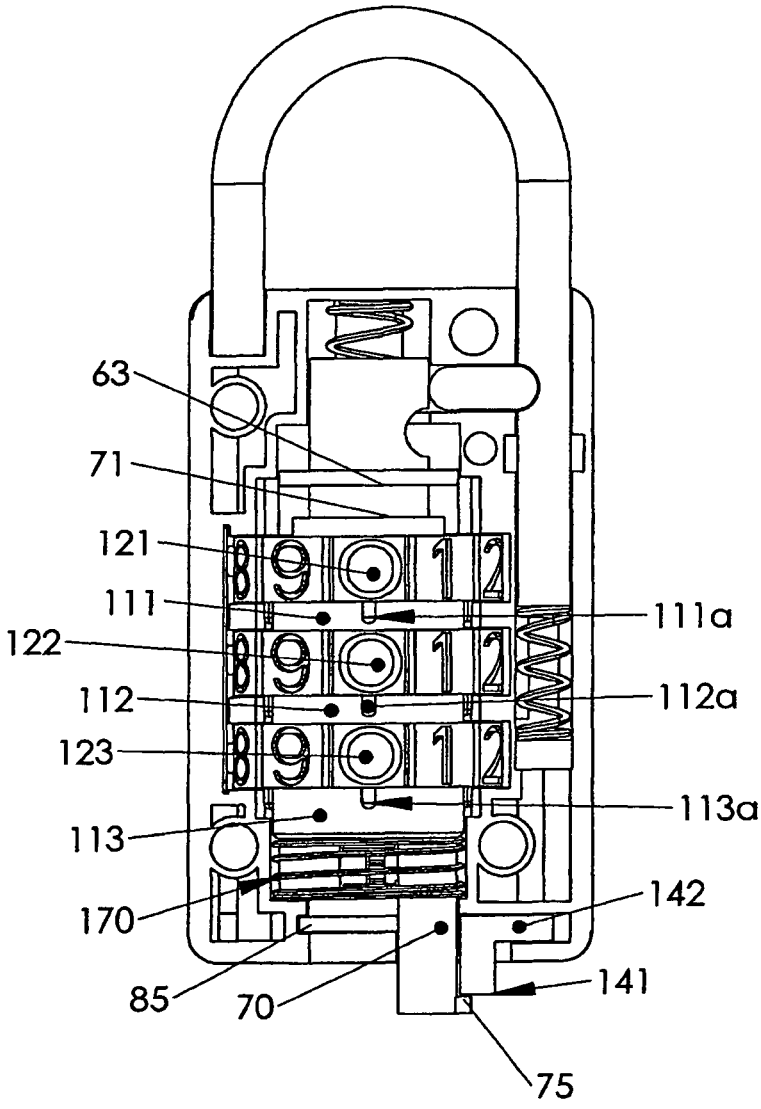
FIG. 20 is a cross-sectional front view of the high-security, dual-mode padlock of the present invention shown fully assembled and in the locked position with one portion of the housing removed.
Figure 21:
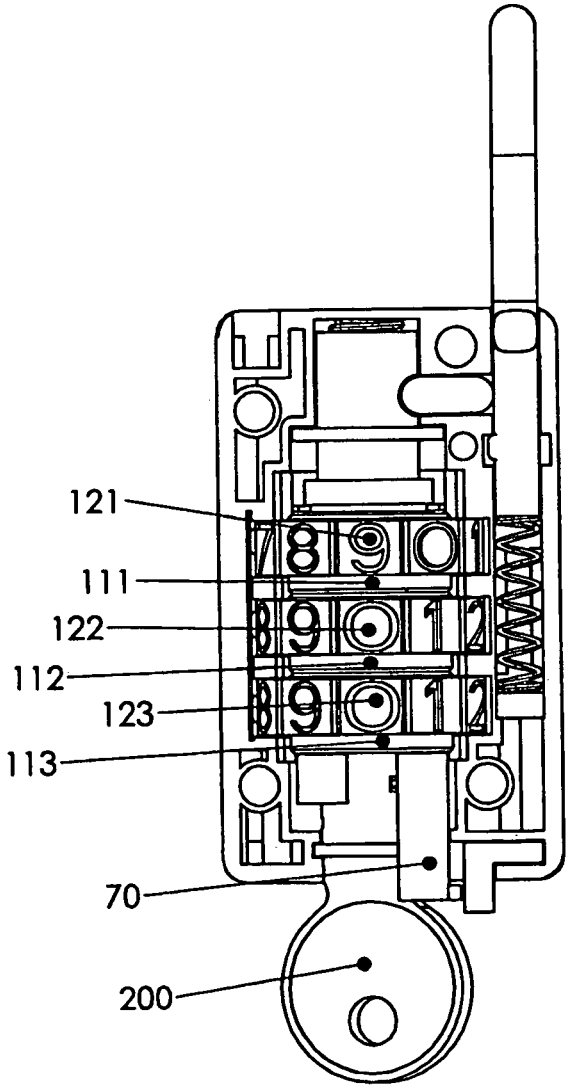
FIG. 21 is a cross-sectional front view of the high-security, dual-mode padlock of the present invention shown fully assembled and in the open position using the key controlled components thereof.
Figure 22:
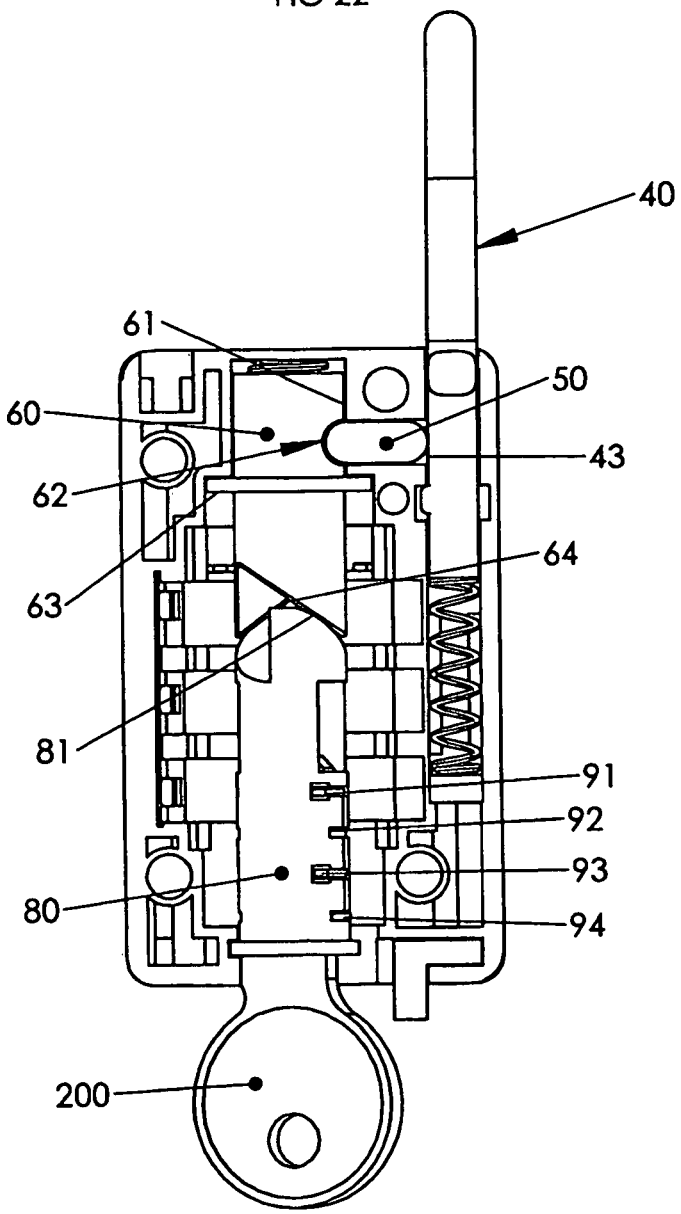
FIG. 22 is a cross-sectional front elevation view of the high-security, dual-mode padlock of the present invention shown in the open position using the key controlled component thereof.
Figure 23:
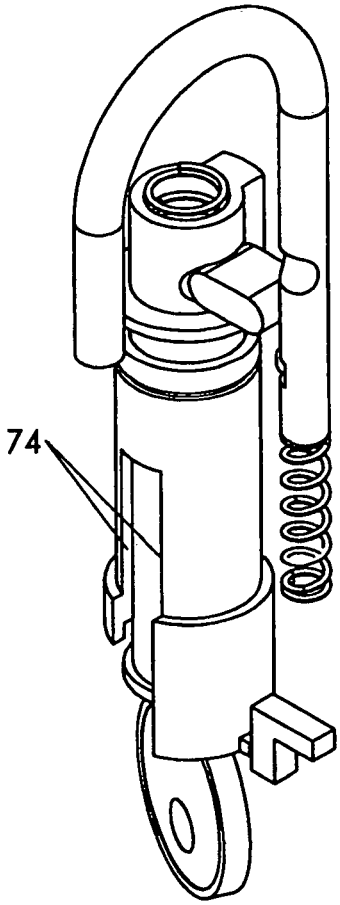
FIGS. 23 and 24 are perspective views of the high-security, dual-mode padlock of the present invention shown in the open position using the key controlled components thereof with the housing removed.
Figure 24:
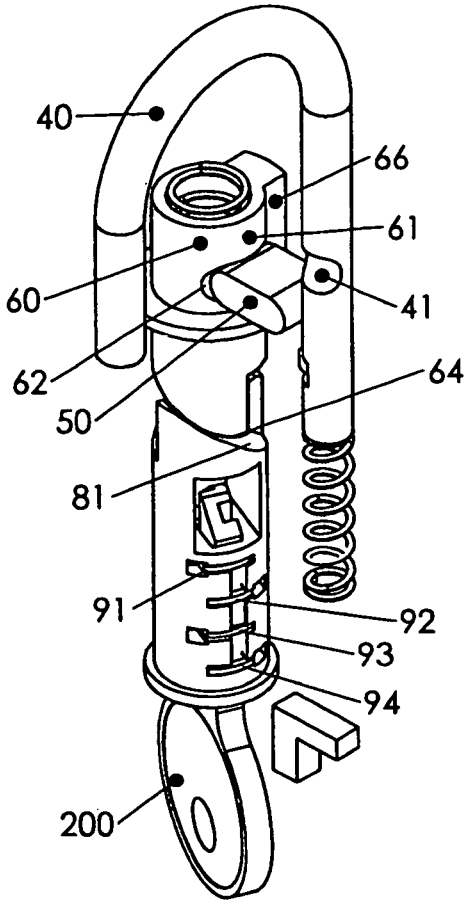

By referring to FIGS. 1-62, along with the following detailed discussion, the construction and operation of several alternate preferred embodiments of dual mode padlock 20 of the present invention can best be understood. In these drawings and in the following detailed disclosure, the alternate preferred embodiments of the present invention are fully detailed. However, it is to be understood that this disclosure is provided for exemplary purposes only in teaching the best modes of the present invention. Consequently, since the present invention can be implemented using further alternate constructions, it is intended that these alternate constructions are within the scope of the present invention.

In FIGS. 1-62, several preferred embodiments of coaxially aligned, dual mode padlock 20 of the present invention are fully depicted using a minimum of principal components formed in a compact configuration. By employing these constructions, a coaxially aligned, dual mode padlock is achieved which is capable of being produced efficiently and effectively, providing a commercially desirable and highly competitive construction. Furthermore, as detailed below, dual mode padlock 20 also incorporates a deadbolt construction which virtually eliminates forced opening of the padlock. As a result, a highly desirable product is realized.

As shown in the drawings, two principal components forming padlock 20 are housing 30 and shackle 40. In the preferred construction, housing 30 comprises two mating sections 31 and 32, and a receiving zone 33 formed therein. As detailed below, receiving zone 33 is constructed for receiving and being cooperatively associated with combination controlled locking components and key controlled locking components, all of which are fully detailed below.

Preferably, shackle 40 comprises a conventional J-shape incorporating short leg 45 and long leg 46, as depicted. In addition, short leg 45 incorporates a terminating end 47, while long leg 46 has terminating end 48. As is more fully detailed below, shackle 40 is in its locked and fully engaged position when short leg 45 is contained within cavity 35 formed in housing 30, and is in the unlocked, open and released position when short leg 45 is disengaged from cavity 35 of housing 30.

In addition to maintaining terminating end 47 of short leg 45 within cavity 35 of housing 30 when padlock 20 is in the locked configuration, padlock 20 also incorporates a deadbolt locking assembly for securely maintaining shackle 40 integrally affixed within housing 30. In order to provide the deadbolt locking construction, padlock 20 incorporates locking bolt 50 mounted within housing 30 and constructed for controlled, lateral, or side-to-side movement. In addition, the locking assembly also comprises cam or control member 60 mounted in housing 30 in cooperating relationship with locking bolt 50 for controlling the lateral movement of locking bolt 50. In this regard, cam/control member 60 is mounted in a receiving cavity formed in housing 30 and constructed for vertical movement relative to locking bolt 50.

As shown in the drawings, and further detailed below, cam/control member 60 incorporates an arcuately curved recess 62 formed in the side wall thereof which is positioned for cooperating with the curved surface of locking bolt 50. Furthermore, shackle 40 incorporates cut-out zone 41 which is dimensioned for receiving the opposed arcuately curved end of locking bolt 50. Finally, the construction of the deadbolt locking assembly is completed by incorporating coil spring member 160 mounted in housing 30 in biasing engagement with cam/control member 60 for maintaining cam/control member 60 continuously biased in a downward direction.

As a result, the outer surface of cam/control member 60 is typically maintained in contact with locking bolt 50 forcing locking bolt 50 to be engaged within cut-out zone 41 of shackle 40. As a result, when in this secure and locked configuration, shackle 40 is incapable of being forcibly removed from housing 32 to the engaging forces provided by locking bolt 50 in cut-out zone 41 of shackle 40. As a result, padlock 20 of the present invention provides substantially enhanced strength resistance and is virtually incapable of being opened by the mere application of typical force on shackle 40 in an attempt to remove shackle 40 from housing 30.

In order to enable shackle 40 to be released from locked engagement in housing 30 using the combination control components of padlock 20, padlock 20 incorporates three separate and independent rotatable dials 121, 122, and 123 which are cooperatively associated with clutches 111, 112, and 113. In the preferred construction, clutches 111, 112 and 113 each comprise a generally cylindrical shape and incorporates at least one locking fin 111*a*, 112*a*, and 113*a* which radially extends from the outer, circular shaped surface thereof.

In addition, clutches 111, 112, and 113 also comprise an inside, circular shaped surface which is coaxially aligned with the outside surface thereof. The diameter of the inside surface of each clutch is constructed to enable each clutch to freely pivot about the outer surface of spindle/cylinder housing/sleeve 70, which is mounted in housing 30 as fully detailed below.

In the preferred embodiment, clutches 111, 112, and 113 each comprise three radially extending fins 111*a*, 112*a*, and 113*a*. In this regard, the construction employed herein is similar to the construction fully detailed in U.S. Pat. No. 7,117,698, the pertinent portions of which are repeated and integrated herein by reference. As fully detailed below, the incorporation of the three radially extending fins 111*a*, 112*a*, and 113*a* on each of the clutches, with the radially extending fins 111*a*, 112*a*, and 113*a* being configured in a unique manner, a high security, tamper-resistant padlocked construction is realized which virtually eliminates the likelihood of the padlock 20 being opened by unauthorized individuals.

Dials 121, 122, and 123 are constructed for peripherally surrounding and cooperating with one of the clutches 111, 112, and 113. In this regard, each dial 121, 122, in 123 comprises two separate and distinct circular shaped inside surfaces with one of said surfaces comprising a diameter slightly greater than the diameter of the outside surface of the clutch, in order to enable the clutch and dial to cooperate with each other while being independently rotationally movable about spindle/cylinder housing/sleeve 70.

Furthermore, each dial 121, 122, and 123 comprises a plurality of slots formed in the inside surface thereof with each slot being constructed for receiving and retaining the radially extending locking fins 111*a*, 112*a*, and 113*a* formed on clutches 111, 112, in 113. In this way, whenever radially extending locking fins 111*a*, 112*a*, and 113*a* are mounted in the slots of dials 121, 122, and 123, the clutches and the dials are in locked engagement, causing both members to rotate together about spindle/cylinder housing/sleeve 70.

In the preferred construction, the number of slots formed in dials 121, 122, and 123 correspond to the number of separate and distinct indicia formed on the outer surface of dials 121, 122, and 123. In the preferred embodiment, ten indicia are employed on the outside surface of dials 121, 122, and 123, with ten slots being formed in the inside surface thereof.

Each dial 121, 122, and 123 comprises a plurality of indicia formed on the outer peripheral surface thereof, with each of the indicia representing one component of the combination for positioning the clutches in the requisite location for enabling locking bolt 50 to be released, as detailed below. Although any desired indicia can be employed, numerals or a letters are typically used.

In the present invention, each dial 121, 122, and 123 comprises an outer surface on which 10 panels are formed with slots separating each panel. In addition, one numeral ranging from 0, 1, 2, 3, 4, 5, 6, 7, 8, and 9 is formed on each panel. The numeral on each panel of each dial is then employed to define the combination for padlock 20.

Furthermore, in the preferred construction of the present invention, enlarged numerals are employed for assuring the ease of readability and visibility. With vision difficulty becoming an ever increasing problem, the enlarged numerals enable such individuals to easily recognize the numerals being displayed due to their increased size and visual appearance.

The padlock 20 further comprises ratchet spring plate 131. Dials 121, 122 and 123 each comprise receiving slots located between each of the plurality of indicia, for receiving the ratchet-spring plate 131. By receiving the ratchet-spring plate 131, the rotating dial 121, 122 or 123 is stopped when each indicia is displayed.

In accordance with the present invention, whenever dials 121, 122, and 123 are positioned with the pre-set combination being properly displayed, the radially extending fins 111*a*, 112*a*, and 113*a* of clutches 111, 112, and 113 are aligned with notches 21*a*, 21*b*, and 21*c* which are formed in housing 30. Whenever this aligned orientation is attained, spindle/cylinder housing/sleeve 70 is able to be axially moved upwardly by the user. As spindle/cylinder housing/sleeve 70 is moved upwardly against the biasing force exerted by spring member 160, top surface 71 of housing/sleeve 70 contacts lower wall/surface 63 of cam/control member 60, causing cam/control member 60 to move upwardly therewith.

In addition, as cam/control member 60 is moved upwardly, curved recess 62 is brought into alignment with locking bolt 50. As a result, locking bolt 50 is no longer sandwiched between the outer surface of cam/control member 60 and cutout zone 41 of shackle 40. Instead, locking bolt 50 is now able to move towards cam/control member 60 with the curved surface of locking bolt 50 entering recess 62 thereof.

This movement enables locking bolt 50 to become disengaged from cut-out zone 41 of shackle 40, effectively releasing the shackle 40 from locked engagement with housing 30 and enabling the shackle 40 to be disengaged and released from housing 30. In this regard, coil spring 130 which is maintained in biasing contact with terminating end 48 of long leg 46 of shackle 40 is able to exert a biasing force to automatically advance shackle 40 out of locked engagement with housing 30.

In addition, in the preferred construction, shackle 40 incorporates a radially extending flange or projection 42 formed on long leg 46 which is constructed to control the axial or longitudinal movement of shackle 40 relative to housing 30. Furthermore, housing 30 incorporates enlarged cavity 23 formed therein which is formed along the elongated bore within which long leg 46 is retained.

In the preferred construction, radially extending projection 42 of shackle 40 is positioned for movement within enlarged cavity 23, thereby limiting the axial movement of shackle 40 to the vertical length of cavity 23. As a result, when shackle 40 is released by the use of either the combination controlled component or the key controlled components, shackle 40 is automatically advanced by spring member 130 into its open position, housing-disengaged position, with this position being limited by the contact between projection 42 and the upper edge of cavity 23.

In order to enable spindle/cylinder housing/sleeve 70 to be axially movable in response to the pre-set combination being entered on dials 121, 122, in 123, housing 30 incorporates notches 21*a*, 21*b*, and 21*c* which are aligned with radially extending fins 111*a*, 112*a*, and 113*a* of clutches 111, 112 and 113. In the preferred embodiment, clutches 111, 112, and 113 each incorporate three separate and independent radially extending fins 111*a*, 112*a*, and 113*a*, each of which are aligned with corresponding notches formed in housing 30 for enabling spindle/cylinder housing/sleeve 70 to be released for axial movement within the housing 30. In addition, in the preferred construction, the three separate and independent, radially extending fins 111*a*, 112*a*, and 113*a* formed on each clutch 111, 112, and 113 are spaced apart from each other in a unique manner, in order to achieve a high security, tamper-resistant padlock 20 which virtually eliminates any likelihood of the padlock 20 being opened by unauthorized individuals.

In this preferred construction, the three locking fins 111*a*, 112*a*, and 113*a* formed on each clutch 111, 112, and 113 are not spaced apart from each other in the equal arcuate distances. Instead, two of the arcuate distances separating the locking fins are equivalent, while the third arcuate distance between adjacent locking fins is substantially different.

Although virtually any desired arcuate distances can be selected for positioning the locking fins on clutches 111, 112, and 113, including having all three of arcuate distances separate and distinct from each other, the present invention requires that at least one of the arcuate spaced instances is dissimilar from the other spaced arcuate distances, even if two of the arcuate spaced distances are equal. By employing this unique construction, substantial additional difficulty is created for any unauthorized individual attempting to determine the combination using known picking techniques.

In this regard, in order to enable spindle/cylinder housing/sleeve 70 to be axially movable whenever the pre-set combination has been entered, housing 30 preferably incorporates three notches 21*a*, 21*b*, and 21*c* formed along the receiving cavity of housing 30 wherein the combination controlled locking components and the key controlled locking components are retained. In addition, with each of the notches 21*a*, 21*b*, and 21*c* being arcuately spaced from each other with the same arcuate spacing employed for the locking fins 111*a*, 112*a*, and 113*a* formed on clutches 111, 112; and 113, each locking fin 111*a*, 112*a*, and 113*a* of each clutch 111, 112, and 113 is automatically aligned with one notch when the dials have been positioned in the precisely desired pre-determined orientation, thereby enabling housing/sleeve 70 to be axially movable.

Since all three locking fins 111*a*, 112*a*, and 113*a* of each clutch 111, 112, and 113 must be aligned with all three notches 21*a*, 21*b* and 21*c* before housing/sleeve 70 can be axially moved, an individual using known picking techniques will have to resolve numerous false readings as one of locking fins becomes aligned with one notch while the other locking fins are not properly aligned. As a result, substantial increased difficulty will be encountered, virtually eliminating the ability of such an individual from being successful.

Furthermore, by combining this construction with the deadbolt or a locking bolt construction detailed above, a substantially enhanced, high security padlock construction is achieved which prevents unauthorized individuals from being able to either open padlock 20 using known picking techniques or succeed in forcibly removing shackle 40 from housing 30. As a result, a desired secure, trouble free padlock is realized in a construction which is compact, efficiently assembled, and competitively priced.

In order to provide the unique, compact, coaxially aligned construction achieved by the present invention, key controlled cylinder 80 is mounted within spindle/cylinder housing/sleeve 70 for independently controlling the movement of cam/control member 60 whenever the proper key is inserted into cylinder 80 for enabling cylinder 80 to arcuately pivot relative to spindle/cylinder housing/sleeve 70. However, in order to prevent cylinder 80 from moving, either arcuately or longitudinally whenever spindle/cylinder housing/sleeve 70 is longitudinally moved in response to the use of the combination controlled component, radially extending flange 85 is formed at the base of cylinder 80 and is mounted in groove 22 which is formed in housing 30. As a result, cylinder 80 is unable to move vertically, horizontally, or arcuately.

In addition, spindle/cylinder housing/sleeve 70 incorporates terminating ends 72 and 73 formed thereon which are placed directly adjacent walls 26 and 36 of housing 30. In the preferred construction, ends 72 and 73 contact walls 26 and 36 of housing 30 effectively preventing housing/sleeve 70 from being arcuately movable, while also assuring that housing/sleeve 70 is vertically movable in the desired manner whenever the proper combination has been entered on dials 121, 122, and 123.

By referring to FIGS. 1-62 in general, and FIGS. 21-24 and 56A-62 in particular, along with the following detailed discussion, the construction and operation of the key controlled locking components of the present invention can best be understood. As discussed above, key activated cylinder 80 is mounted in spindle/cylinder housing/sleeve 70, co-axially aligned therewith, as well as with rotatable dials 121, 122, and 123. In addition, in the preferred construction, cylinder 80 incorporates substantially flat disks or plates 91, 92, 93, and 94, each of which are spring biased to extend outwardly from cylinder 80 when in the locked position.

Furthermore, housing/sleeve 70 incorporates longitudinally extending slot 74 formed therein which is positioned for cooperating with disks 91, 92, 93, and 94 for receiving and retaining disks 91, 92, 93, and 94 therein when said discs are extended outwardly from cylinder 80. In this way, cylinder 80 is incapable of being arcuately pivoted relative to housing/sleeve 70 due to the engagement of disks 91, 92, 93, and 94 with slot 74. As a result, cylinder 80 remains in locked engagement with housing/sleeve 70.

Furthermore, cylinder 80 is constructed in a manner which causes disks 91, 92, 93, and 94 to be automatically withdrawn from their outwardly extending position whenever key 200, with the correct predetermined cuts and ridges formed therein, is inserted into cylinder 80. In this regard, whenever the pre-designated key 200 is inserted into the receiving slot formed in the terminating end of cylinder 80, disks 91, 92, 93, and 94 are automatically forced inwardly into cylinder 80, removing disks 91, 92, 93, and 94 from engagement with slot 74 of housing/sleeve 70. As a result, cylinder 80 is now able to be arcuately pivoted about its central axis relative to housing/sleeve 70.

As shown in the drawings, the terminating end of cylinder 80, which is mounted in padlock 20, incorporates a V-shaped, sloping camming surface 81 formed therein, which is positioned in cooperating, movement controlling engagement with a corresponding V-shaped, sloping camming surface 64 formed on the lower end of cam/control member 60. As a result of this construction, whenever cylinder 80 receives key 200 and is arcuately pivoted, V-shaped, sloping camming surface 81 arcuately rotates simultaneously therewith causing camming surface 81 to be brought into contact with V-shaped, sloping camming surface 64 of cam/control member 60 and effectively force cam/control member 60 to move vertically upwardly against the biasing force of coil spring member 160.

As cam/control member 60 moves upwardly, curved recess 62 of cam/control member 60 is brought into alignment with locking bolt 50, enabling locking bolt 50 to move into recess 62, removing locking bolt 50 from engagement in cut-out zone 41 of shackle 40. Once locking bolt 50 has been removed from engagement in cut-out zone 41 of shackle 40, shackle 40 is released and is able to automatically move into its unlocked position in response to the force exerted by the biasing spring 130.

In addition, in the preferred construction, cam/control member 60 incorporates radially extending ledge or wall 66 formed on the outer surface thereof which is positioned within receiving slot 24 formed in housing 30. By employing this construction, cam/control member 60 is incapable of arcuately pivoting or rotating due to the arcuate pivoting contact of camming surface 81 with camming surface 64, and only the desired vertical movement of cam/control member 60 is possible.

As discussed above, the key controlled locking components incorporated into padlock 20 of the present invention are constructed to enable transit security officers to unlock padlock 20 in order to perform inspections of suitcases or luggage which require visual inspection. In this regard, in accordance with the new requirements, the inspector is able to withdraw key 200 from housing 30 while padlock 20 is in the open, unlocked position.

In this regard, even when the security officer or inspector rotates cylinder 80 back to its original position in order to remove key 200 therefrom, padlock 20 remains in the open, unlocked position due to the sandwiched engagement of locking bolt 50 between recess 62 of cam/control member 60 and the outer surface of long leg 46 of shackle 40. Due to this sandwiched interengagement, the open position is maintained.

Furthermore, whenever padlock 20 is to be returned to the luggage and the luggage relocked, a security officer or inspector needs only to return shackle 40 into its original locked position in housing 30. By arcuately moving long leg 46 of shackle 40 in the receiving bore of housing 30, cut-out zone 41 of shackle 40 becomes aligned with locking bolt 50, enabling spring 160 which is engaged with the top surface of cam/control member 60 to force cam/control member 60 downwardly, while simultaneously causing locking bolt 50 to move horizontally into engagement with cutout zone 41 of shackle 40. Once locking bolt 50 has moved into engagement with cut-out zone 41, cam/control member 60 continues to move downwardly bringing its outer surface into contact with the opposed end of locking bolt 50, securely locking padlock 20 in its original position, with locking bolt 50 returned to its original break resistant configuration.

This operation is referred to as the key non-captive system, since key 200 is used by the security officer or inspector to open padlock 20 while enabling the complete removal of key 200 immediately after padlock 20 has been opened and remains open. As a result, key 200 is not captured within padlock 20 during the inspection process and can be immediately returned to its original location. In addition, lock 20 automatically returns to the re-locked configuration whenever shackle 40 is returned into engagement and housing 30. In this way, inspection time is reduced and efficiency is substantially enhanced.

In accordance with the foregoing detailed disclosure, a high security, tamper resistant and breakage resistant padlock is achieved by employing the present invention. Furthermore, a uniquely constructed, compact configuration is realized by coaxially aligning the combination controlling components and the key controlling components of the padlock. In this way, a compact padlock is realized, which is capable of being produced efficiently and economically. Furthermore, by incorporating a deadbolt locking construction inherent in the padlock, a substantially improved, breakage and theft resistant, high security padlock is achieved.

In accordance with the present invention, the combination controlled components employed in the present invention are constructed to enable the user to preselect any desired combination for opening padlock 20. In this regard, the user merely opens padlock 20 using dials 121, 122, and 123 and then manually pulls housing/sleeve 70 downwardly in order to cause fins 111*a*, 112*a*, and 113*a* of clutches 111, 112, and 113 to disengage from teeth 121*a*, 122*a* and 123*a* of dials 121, 122, and 123.

Once this position has been achieved, reset plate 142, which is mounted to the bottom of housing 30, is slid sideways into engagement with radially extending flange 75 formed on the lower end of housing/sleeve 70. Once bottom edge 141 of plate 142 securely engages flange 75, housing/sleeve 70 is secured in the reset position. Once in this position, the user can use both hands to rotate dials 121, 122, and 123 for placing the dials in any desired combination or orientation.

Once the new combination has been established, the user merely removes plate 142 from engagement with flange 75 thereby releasing housing/sleeve 70 and enabling housing/sleeve 70 to move back to its original locked position. This axial movement is further enhanced and automatically achieved by incorporating spring member 170 in housing 30 position for biasing housing/sleeve 70 upwardly and forcing clutches 111, 112, and 113 upwardly along with dials 121, 122, and 123. In this way, all of the combination controlling components are returned to their original locked position with the new combination having been established.

Figure 25:
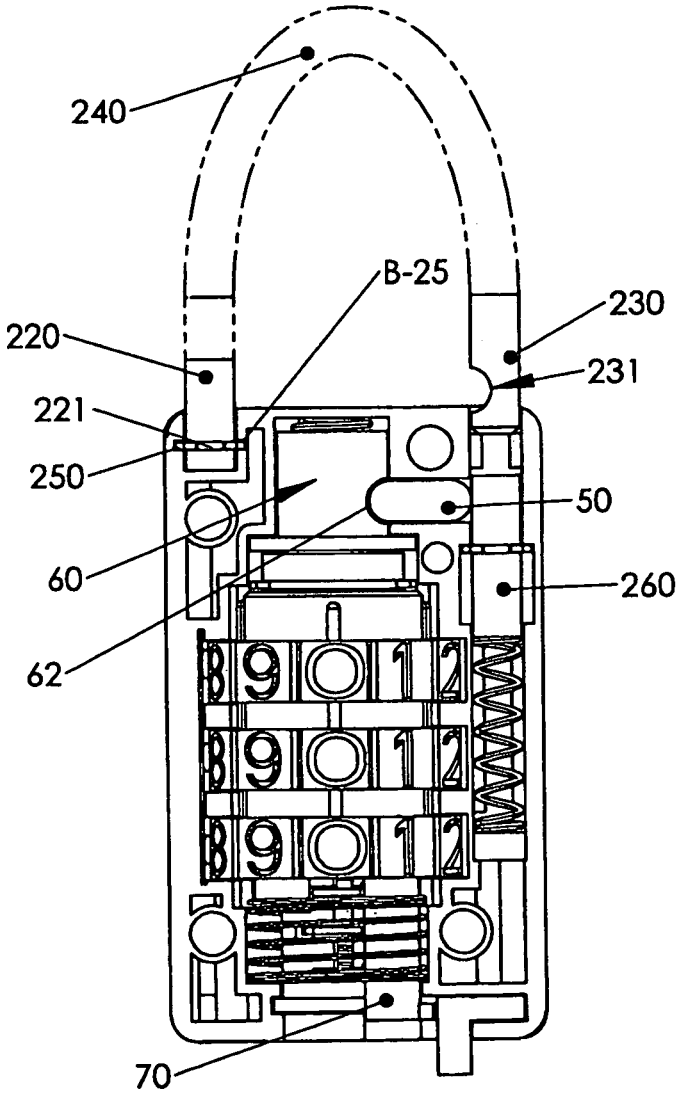
FIG. 25 is a front elevation view of an alternate embodiment of the high-security, dual-mode padlock of the present invention.
Figure 26A:
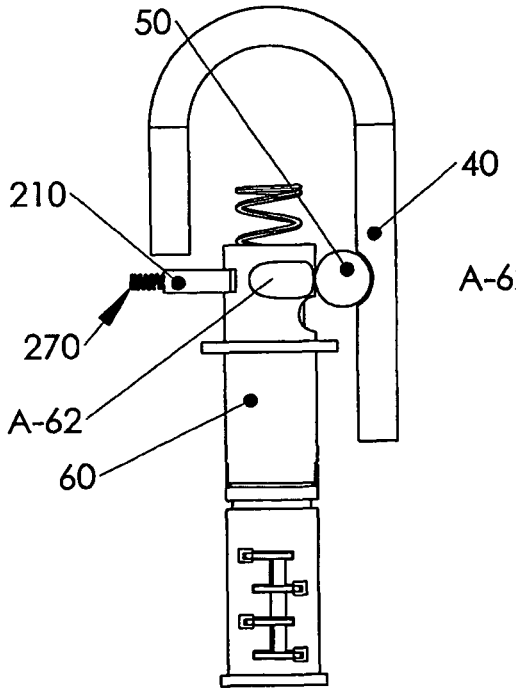
FIGS. 26A-28 are a series of views showing an alternate control construction for the high-security, dual-mode padlock of the present invention.
Figure 26B:
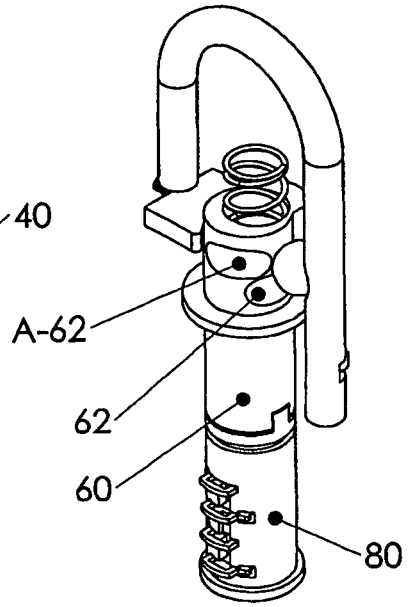
Figure 27A:
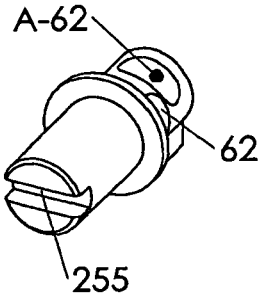
Figure 27B:
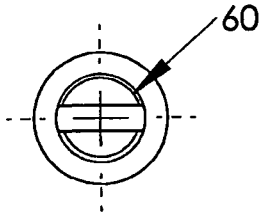
Figure 28:
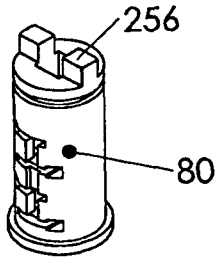

In FIG. 25, an alternate embodiment of the high security, dual mode padlock 20 of the present invention is depicted. In this embodiment, the construction detailed above is substantially identical, except for the substitution of the alternate shackle configuration. In this regard, as shown in FIG. 25, the shackle employed in this embodiment of the present invention incorporates an elongated cable 240 which is constructed with terminating locking ends 220 and 230, one of which is fixedly mounted to housing 30, while the other locking end is removably lockable to housing 30.

As depicted, terminating locking end 220 is fixedly mounted to housing 30 by securely affixing outer ring 250 on narrowed neck portion 221 of locking end 220 with ring 250 being securely retained in housing 30 by neck ring slot B-25. In this way, locking end 220 is secured to housing 30 and is not removable therefrom.

The opposed terminating locking end 230 preferably comprises cut-out zone 231 which is constructed for cooperating with locking bolt 50, in the manner detailed above in reference to cut-out zone 41 of the shackle 40. Furthermore, in order to assure the desired removable operation of locking end 230 from housing 30, tube or post 260 is mounted in housing 30 in cooperating relationship between locking end 230 and spring member 130. By incorporating tube or post 260 in housing 30, the desired automatic removal of locking end 230 is assured whenever padlock 20 is open by using either the key controlled locking components or the combination controlled locking components.

By referring to FIGS. 26A-28, an alternate construction for cylinder 80 and cam/control member 60 is fully depicted. In this alternate embodiment, the arcuate pivoting movement of cylinder 80 is transferred directly to cam/control member 60, causing cam/control member 60 to arcuately pivot simultaneously therewith. In addition, as depicted, locking bolt 50 is shown in an alternate embodiment as a spherically shaped ball member.

In order to achieve the desired arcuate, pivoting movement, cam/control member 60 incorporates a slot 255 formed along the bottom surface thereof, while cylinder 80 incorporates an upstanding flange or ridge 256 formed at the cooperating end thereof. By mounting ridge/flange 256 in slot 255, the arcuate pivoting movement of cylinder 80, which is achievable in response to the receipt and turning of the predetermined key, causes cam/control member 60 to arcuately pivot therewith.

As cam/control member 60 is arcuately pivoted by cylinder 80, additional or secondary curved zone A-62 formed on cam/control member 60 is brought into alignment with locking bolt 50. Once secondary curved zone A-62 is aligned with locking bolt 50, locking bolt 50 is able to become disengaged from cut-out zone 41 of shackle 40, thereby releasing shackle 40 from locked engagement in housing 30.

In order to provide this embodiment of the present invention with a non-key-captive operation, latch plate 210 is incorporated into padlock 20 along with biasing spring 270 mounted to the tip of latch plate 210. In this regard, when padlock 20 is in the open configuration, with shackle 40 removed from housing 30 and the key removed from cylinder 80, the security officer or inspector is able to return padlock 20 into the locked position by merely moving shackle 40 back to its original position. In this regard, as shackle 40 is returned into locked engagement in housing 30, latch plate 210 with spring 270 forces cam/control member 60 to have a clockwise movement which disengages locking bolt 50 from recess 62 and forces locking bolt 50 into engagement with cut-out zone 41 of shackle 40.

Figure 30:
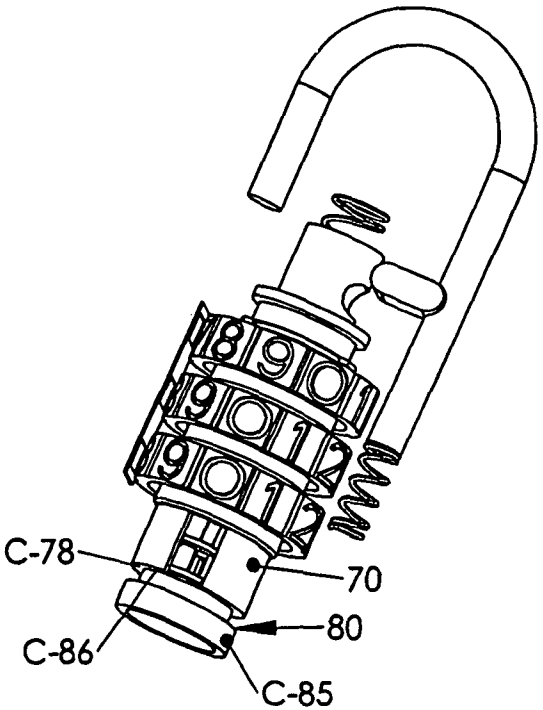
FIG. 30 is a perspective view of the high-security, dual-mode padlock of FIG. 29 shown with both portions of the housing removed.
Figure 29:
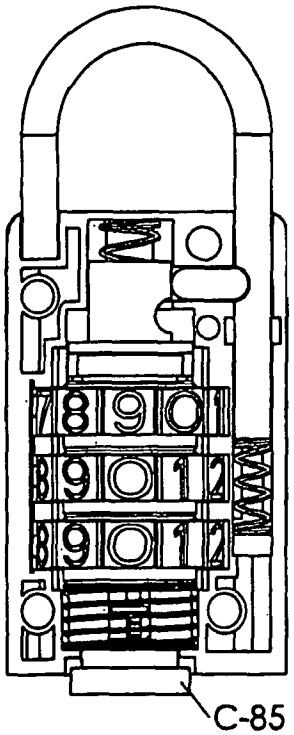
FIG. 29 is a front elevation view of an alternate embodiment of the high-security, dual-mode padlock of the present invention, shown fully assembled and in the locked position with a portion of the housing removed.
Figure 31:
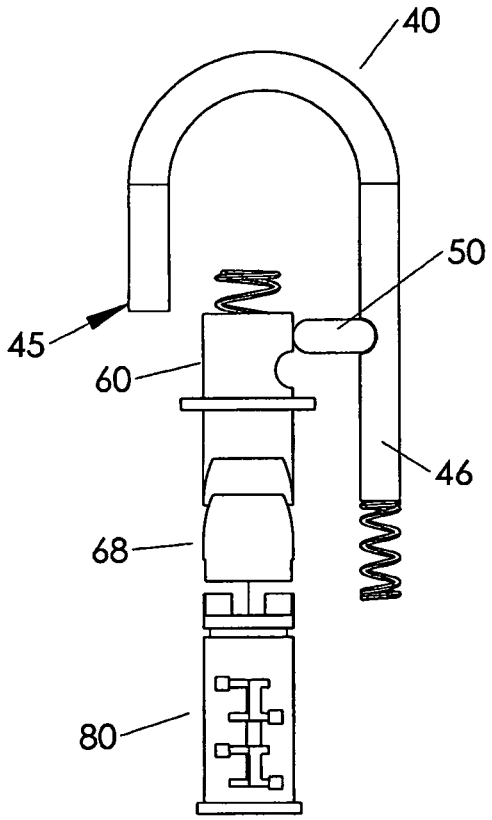
FIG. 31 is a side elevation view of a still further alternate construction of the high-security, dual-mode padlock of the present invention depicted with the housing removed.
Figure 32:
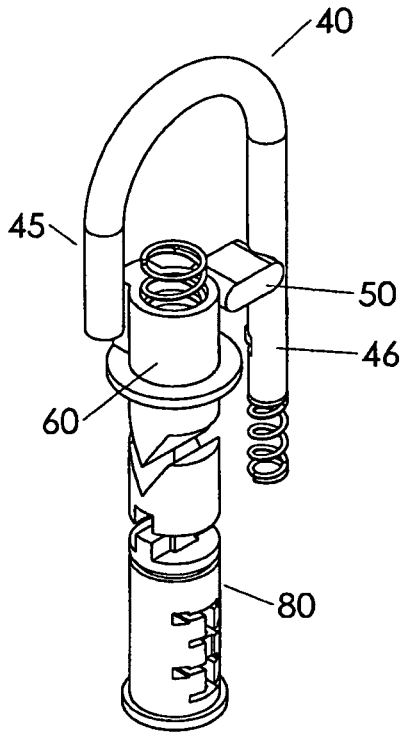
FIG. 32 is a perspective view of the high security, dual mode padlock embodiment of FIG. 31.
Figure 33:
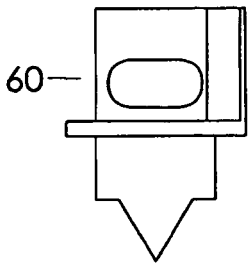
FIG. 33 is a side elevation view of the control member employed in the high-security, dual mode padlock embodiment of FIG. 31.
Figure 34:
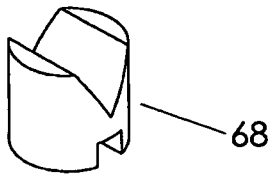
FIG. 34 is a perspective view of an intermediate cam connecting element incorporated into the high-security, dual mode padlock embodiment of FIG. 31.
Figure 35:
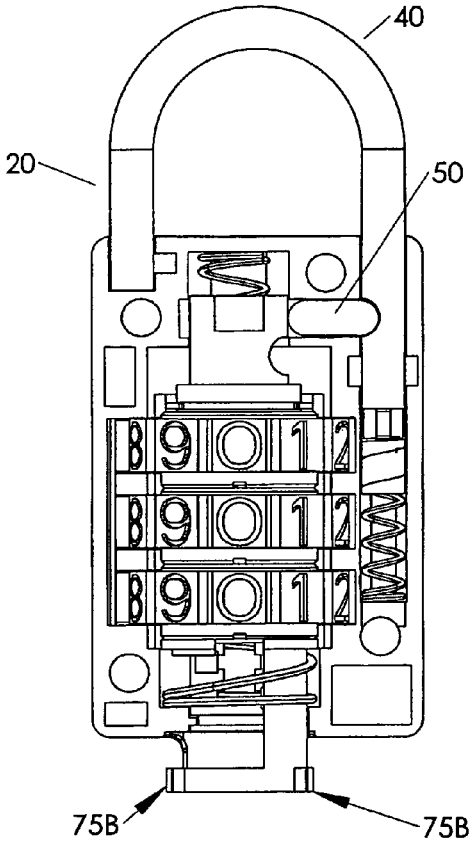
FIG. 35 is a side elevation view of a further alternate construction of the high-security, dual mode padlock of the present invention with one portion of the housing removed.
Figure 36:
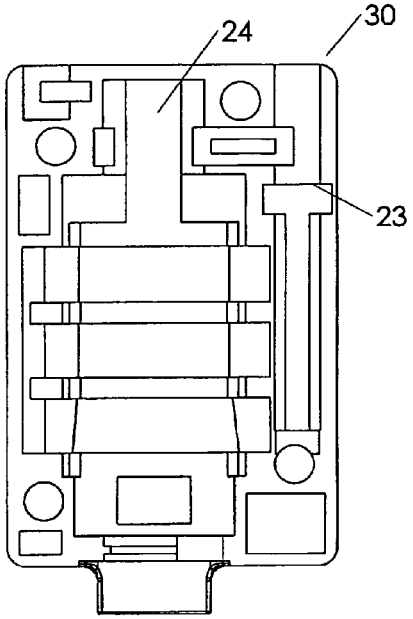
FIG. 36 is a side elevation view depicting one portion of the housing of the dual mode padlock embodiment of FIG. 35.
Figure 37:
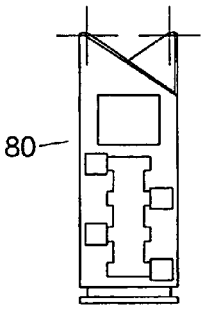
FIG. 37 is a side elevation view of the cylinder assembly employed in the dual mode padlock embodiment of FIG. 35.
Figure 38:
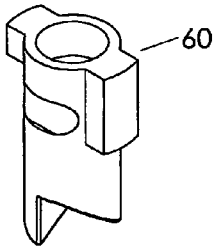
FIG. 38 is a perspective view of the control member employed in the dual mode padlock embodiment of FIG. 35.
Figure 39:
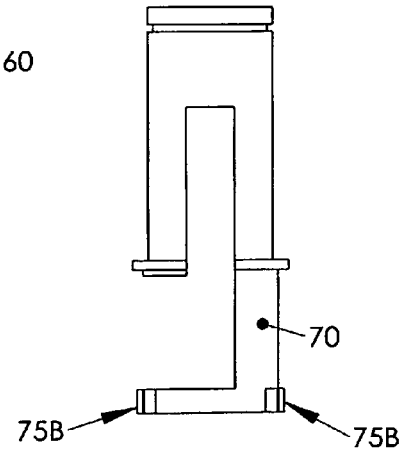
FIG. 39 is a side elevation view of the sleeve member employed in the dual mode padlock embodiment of FIG. 35.

In FIGS. 29-30, a further alternate embodiment for constructing padlock 20 of the present invention is depicted. In this alternate embodiment, cylinder 80 is constructed for being axially movable in housing 30 for directly activating and longitudinally moving cam/control member 60 whenever the combination controlled component are employed. As shown, in this embodiment, cylinder 80 is constructed with larger diameter base C-85 for functioning as an easily accessed pushbutton whenever the user wishes to open padlock 20 after the correct combination has been entered on dials 121, 122, and 123.

In this regard, when the dials have been placed in the lock open position, edge C-86 of cylinder 80 pushes bottom surface C-78 of spindle/cylinder housing/sleeve 70 upwardly causing cam/control member 60 to be moved upwardly therewith for enabling locking bolt 50 to be aligned with curved recess 62, thereby releasing shackle 40 from locked engagement with locking bolt 50. In this way, shackle 40 is quickly and easily released.

In FIGS. 31-34, an alternate construction for vertically moving cam/control member 60 relative to cylinder 80 is depicted. In this embodiment, V-shaped cam surfaces are formed on the base of cam/control member 60 which cooperates either directly with a cooperating surface formed on cylinder 80, or cooperates with a separate component 68 mounted between cylinder 80 and cam/control member 60. Regardless of which construction is employed, the rotational movement of cylinder 80 causes cam/control member 60 to move vertically upwardly, in the manner detailed above, for achieving the release of shackle 40 from locked engagement with locking bolt 50.

In FIGS. 35-39, an alternate construction for the combination controlled locking section of dual mode padlock 20 of the present invention is depicted. In this alternate embodiment, housing/sleeve 70 incorporates readily accessible extension tabs 75B formed on the bottom edge thereof which are positioned for enabling rapid access by the user. By employing radially extending, readily accessible tabs 75B, the user is able to quickly and easily access housing/sleeve 70 during the combination resetting process and axially move housing/sleeve 70 downwardly, when the preset combination has been entered, for enabling the user to alter the preset combination. Once the new combination has been set, tabs 75B are released and housing/sleeve 70 automatically returns to its original position due to the biasing forces of spring 170.

Figure 40:
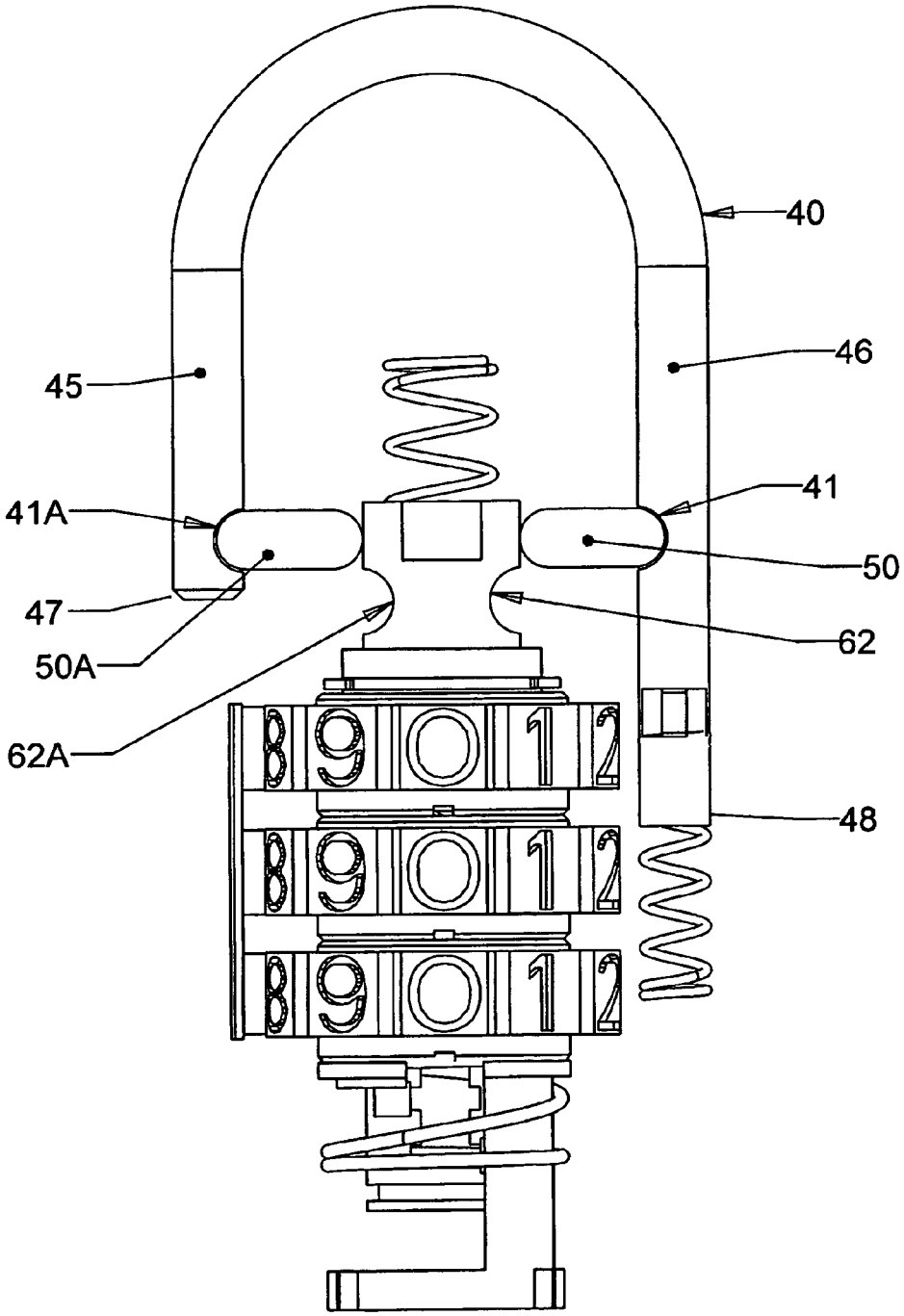
FIG. 40 is a side elevation view of a still further alternate embodiment of the dual mode padlock of the present invention with the housing removed.

In FIG. 40, a further alternate embodiment of padlock 20 of the present invention is depicted. In this embodiment, padlock 20 comprises two separate and independent locking bolts 50 and 50A, each of which cooperates with cam/control member 60 and shackle 40. As depicted and detailed above, locking bolt 50 cooperates with cut-out zone 41 of the long leg 46 of shackle 40 and arcuately curved recess 62 of cam/control member 60. Each of these components operate in the precise manner fully discussed above in order to provide the desired locked interengagement of shackle 40 with housing 30 of padlock 20.

In this embodiment, in order to provide a further enhanced locked interengagement of shackle 40 with housing 30 of padlock 20, padlock 20 incorporates a second locking bolt 50A which cooperates with arcuately curved recess 62A formed in cam/control member 60 and arcuately curved recess 41A formed in short leg 45 of shackle 40. The controlled movement and operation of locking bolt 50A is substantially identical to the controlled movement and operation of locking bolt 50, as detailed above, with locking bolt 50A providing a further enhanced and improved deadbolt locking construction which virtually eliminates any possibility that shackle 40 can be withdrawn from housing 30 using force. As a result, this alternate embodiment of the present invention provides a further improvement to the overall construction and protection provided by padlock 20.

In addition to the dual mode padlock embodiments detailed above, as well as the alternate constructions and variations for these embodiments, all of which are shown in FIGS. 1-40 and have been fully detailed above, a still further alternate embodiment of dual mode padlock 20 has been developed incorporating numerous additional features and structural variations. In this regard, however, many construction details defined above are incorporated as an integral part of the further embodiment of the present invention shown in FIGS. 41-62. Consequently, the detailed description provided above is hereby repeated and incorporated by reference in order to fully define the construction of this further alternate embodiment.

In addition, the following detailed disclosure specifically describes variations of construction incorporated into this additional preferred embodiment in order to provide a full and complete disclosure of this further invention. As a result, the following detailed discussion focuses upon the alternate construction details of this additional invention without specific reference to the common structural elements incorporated into this additional embodiment which have been previously described.

In this additional, improved embodiment of the present invention, several unique features and variations of structural elements have been made to achieve a deadbolt locking mechanism possessing stronger locking strength. Furthermore, unique features incorporated into this further embodiment achieve enhanced operational performances as well as improvements which further reduce and virtually eliminate the ability of the dual mode padlock of the present invention to be opened by unauthorized personnel, whether employing force or known picking techniques. As a result, as is evident from the disclosure provided herein, this additional improved embodiment achieves a dual mode padlock construction which can be employed in universal applications with enhanced operational features, structural integrity, and broad applicability.

One of the principal features incorporated into this further additional embodiment is a construction which enables cam/control member 60 to be arcuately pivoted upon activation, as opposed to axial or longitudinal movement for activation as disclosed above. As detailed below, whenever the key controlled section or combination controlled section of padlock 20 is employed, cam/control member 60 is activated for arcuate pivoting or rotational movement in housing 30 in order to release shackle 40 from locked engagement therewith. By employing this construction, the overall length of padlock 20 is reduced and the possibility that padlock 20 may be opened using aggressive force is virtually eliminated.

A further feature incorporated into this embodiment of padlock 20 of the present invention is the use of a key by the padlock owner in order to reset the combination which will release the padlock. As a result, padlock 20 of the present invention can be employed to protect a wide variety of products, businesses, or property which must be accessed by several individuals using the combination. In this way, the multiple authorized individuals are able to use a combination to gain access to the products, businesses, or property, while being incapable of resetting the combination in order to prevent other authorized people from gaining access to the particular location. Only the owner is able to alter the pre-designated combination by employing the reset key.

In further additional feature incorporated into this further embodiment of dual mode padlock 20 is the creation of a specially constructed housing or cover which enables the owner to effectively secure the padlock in a combination resetting mode for enabling hands-free operation of the padlock during the resetting mode. In this way, the owner is able to more freely rotate the dials to any desired position for establishing a new combination, followed by the release of the reset lock mode into the normal operational mode. Finally, in this additional further embodiment of the present invention, the combination dials employed in padlock 20 incorporate a unique, two-step construction which reduces any gap between adjacent dials, thereby virtually eliminating the ability of individuals to insert picking instruments into the gap between the dials in an attempt to unlock padlock 20 without authority.

By referring to FIG. 41-62, along with the following detailed disclosure, the preferred constructions for providing these enhanced features and operational improvements can best be understood. In addition, it is also to be understood that these additional construction features and operational improvements may be employed individually or in combination with each other, as well as individually or in combination with all of the features and elements detailed above and discussed in the embodiment shown in FIG. 1-40. As a result, it should be understood that the present invention is not limited to any particular combination of features or elements and any desired combination of features detailed herein can be implemented without departing from the scope of the present invention.

By referring to FIGS. 41-62, along with the following detailed discussion, the preferred construction of this further alternate embodiment of the dual mode padlock 20 of the present invention can best be understood. In addition, the preferred features and operational elements of this alternate embodiment will also be evident from a review of these drawings and the following detailed discussion.

As depicted, this further alternate embodiment of dual mode padlock 20 is constructed using a minimum number of principal components formed in a compact, coaxially aligned configuration to provide a deadbolt construction which virtually eliminates forced openings. In this regard, padlock 20, as with the embodiments detailed above, comprises housing 30, and shackle 40, with housing 30 constructed in two mating sections 31 and 32, with sections 31 and 32 forming a receiving zone 33 (not shown in FIGS. 41-62) constructed for receiving and being cooperatively associated with combination controlled locking components and key controlled locking components, all of which are fully detailed herein.

Shackle 40 comprises a conventional J-shape incorporating short leg 45 and long leg 46, with short leg 45 incorporating a terminating end 47 while long leg 46 has terminating end 48. Furthermore, shackle 40 incorporates cutout zone 41 formed in long leg 46 for receiving a portion of locking bolt 50. In addition, in this embodiment, shackle 40 incorporates a cutout zone 41 formed in short leg 45 of shackle 40 for receiving a portion of a second locking bolt 50.

As more fully detailed below, as well as thoroughly discussed above, locking bolt 50 is cooperatively associated with cam/control member 60 for controlling the movement of locking bolt 50 between locked engagement in cutout zone 41 of shackle 40 and the release of locking bolt 50 to enable shackle 40 to be removed from locked engagement in housing 30. Furthermore, in this embodiment, cam/control member 60 cooperates with two locking bolts 50 to provide enhanced locking and unlocking operation.

In this embodiment of the present invention, cam/control member 60 is mounted in a receiving cavity formed in housing 30 and constructed for arcuate, pivoting movement within housing 30 in cooperating association with locking bolts 50. In this regard, cam/control member 60 incorporates enlarged arcuately curved recesses 62 formed in the outer surface thereof, with recesses 62 positioned for cooperating relationship with locking bolts 50. As a result of this relationship, locking bolts 50 are maintained in locked interengagement in cutout zones 41 of shackle 40 whenever cam/control member 60 is in its padlock locking position, while being disengaged from locked interengagement in cutout zone 41 whenever cam/control member 60 is in its released position whenever arcuately curved recess 62 is aligned with locking bolt 50.

In this regard, the outer surface of cam/control member 60 is typically maintained in contact with locking bolts 50 for forcing locking bolts 50 to be engaged within cutout zones 41 of shackle 40. As a result, when in this secure and locked configuration, shackle 40 is incapable of being forcibly removed from housing 30 due to the engaging forces provided by locking bolts 50 in cutout zones 41 of shackle 40.

In order to enable shackle 40 to be released from locked engagement in housing 30, cam/control member 60 must be arcuately pivoted in order to align curved recess 62 with locking bolts 50. When in this position, locking bolts 50 are able to move laterally out of engagement with cutout zones 41 of shackle 40, enabling shackle 40 to be released from housing 30.

In order to enable cam/control member 60 to arcuately pivot in the desired manner in housing 30 of padlock 20, flat coil spring member 160 is mounted in housing 30 engaged between the top surface of cam/control member 60 and housing 30. In this construction, flat coil spring member 160 comprises a plurality of arcuately curved, spiral formed spring elements which are constructed with each coil having an increasing diameter effectively peripherally surrounding the previous coil. As a result, a flat spring construction is realized which produces arcuate forces, as opposed to the axial or longitudinal forces produced by typical coil springs.

In the preferred construction, flat coil spring 160 incorporates tail 161 formed at the outer terminating end of a flat coil spring 160, with tail 161 constructed for being inserted and retained in slot 24 of section 32 of housing 30. Furthermore, locking finger 162 is formed extending from the inside terminating end of flat coil spring 160, with locking finger 162 being constructed for mounted engagement in spring receiving slot 65 which is formed in upstanding boss 69 on the top surface of cam/control member 60.

In this way, flat coil spring 160 is anchored at one end in housing 30 and anchored at its opposed end in slot 65 of cam/control member 60. As a result, flat coil spring 160 continuously exerts an arcuate force on cam/control member 60, attempting to continuously rotate cam/control member 60 about its central axis. In this way, cam/control member 60 is continuously biased to maintain outer surface 61 thereof in contact with locking bolts 50, thereby assuring padlock 20 is normally maintained in the locked position. Furthermore, in the preferred construction, cam/control member 60 incorporates an abutment stop or edge 66 which is positioned for contacting surface 25 of housing 30 in order to maintain cam/control member 60 in position for holding locking bolt 50 in the engaged and locked position with shackle 40.

Outer surface 61 of cam/control member 60 restricts the movement of locking bolts 50, maintaining locking bolts 50 in engagement with cutout zones 41 of shackle 40. When in this position, shackle 40 is securely locked in engagement with housing 30 of padlock 20. Furthermore, as depicted, the preferred construction of this embodiment of the present invention incorporates two cooperating locking bolts 50 mounted on opposed sides of cam/control member 60 with each locking bolt 50 engaging a separate and independent cutout zone 41. In this embodiment, cutout zones 41 are formed in both long leg 46 of shackle 40 as well as short leg 45 of shackle 40. In this way, added security is provided and the ability of padlock 20 to be opened by employing excessive force is virtually eliminated.

In addition, in this embodiment of the present invention, padlock 20 incorporates guard element 39 which peripherally surrounds a portion of mating sections 31 and 32 of housing 30. By employing guard element 39, added protection is provided for preventing housing 30 from being forcibly split apart into two halves when attacked by an individual using tools such as hammers and screwdrivers.

As clearly shown in the drawings, this further embodiment of the present invention incorporates a combination controlled/locking section, and a key control locking section each of which are capable of being used independently to release shackle 40 from locked engagement with housing 30. In this regard, the combination controlled locking section is constructed in a manner substantially identical to the construction detailed above in regard to the alternate embodiments, and the foregoing detailed disclosure regarding these components is hereby repeated by reference, with like numerals being employed for designating substantially identical elements.

In particular, in this embodiment, padlock 20 incorporates spindle 70 which is mounted in housing 30 with rotatable dials 121, 122, 123, and 124, and cooperating clutches 111, 112, 113, and 114 mounted together peripherally surrounding spindle 70. Furthermore, radially extending fins 111*a*, 112*a*, 113*a*, and 114*a* are formed on clutches 111, 112, 113, and 114 and are constructed to be aligned with notches 21*a*, 21*b*, 21*c*, and 21*d* of housing 30 whenever dials 121, 122, 123, and 124 are properly positioned to display the pre-determined combination. Once this position has been attained, spindle 70 is able to be axially moved in housing 30.

In this embodiment of the present invention, spindle 70 incorporates tip 76 which is constructed for holding engagement with enlarged button 100. In the preferred construction, button 100 is mounted to tip 76, with tip 76 being riveted to button 100 for securely affixing button 100 to tip 76 of spindle 70. As a result, the desired axial movement of spindle 70 is quickly and easily achieved by merely pressing button 100.

In this embodiment, spindle 70 incorporates sloping cam surfaces 71 formed on the end of spindle 70 which is opposite from the end of spindle 70 incorporating tip 76. Consequently, whenever button 100 is pressed for causing spindle 70 to move axially in housing 30, sloping cam surfaces 71 of spindle 70 contact sloping surfaces 63 formed on the bottom of cam/control member 60. Once cam surfaces 71 contact cam surfaces 63, cam/control member 60 is forced to arcuately rotate. As a result, as is evident from this disclosure, the vertical movement achieved by spindle 70, when the predetermined combination has been properly set, is transformed into rotational movement of cam/control member 60 due to the interaction of cam surfaces 71 with cam surfaces 63.

As cam/control member 60 rotates, curved recesses 62 of cam/control member 60 become aligned with locking bolt 50. Once this position is achieved, both locking bolts 50 are able to move laterally, simultaneously disengaging from cutout zones 41 of shackle 40 and enabling shackle 40 to be released from locked engagement with housing 30. Furthermore, by incorporating spring 130 in housing 30 in contact with terminating end 48 of long leg 46 of shackle 40, shackle 40 will automatically be forced upwardly into its fully disengaged position.

Preferably, shackle 40 incorporates projection 42 formed on the outer surface of long leg 46, with projection 42 being constructed for contacting edge 23A of housing 30, limiting the axial movement of shackle 40 in housing 30. Furthermore, edge 23A of housing 30 is constructed to prevent the axial movement of shackle 40 by contacting projection 42, while still enabling shackle 40 to arcuately rotate about the axis of long leg 46 when shackle 40 is in its open position.

Another feature incorporated into this embodiment of the present invention is the construction of dial 121 with steps

121*b* extending from both the upper and lower edges of dial 121. By employing this construction, unauthorized individuals are prevented from inserting picking tools into padlock 20 in attempting to locate and move fins 111*a*, 112*a*, 113*a*, and 114*a* of clutches 111, 112, 113, and 114 and to open padlock 20. Furthermore, the incorporation of steps 121*b* also prevents unauthorized individuals from looking into the gap typically formed between rotating dials in an attempt to observe the placement of the locking fins 111*a*, 112*a*, 113*a*, and 114*a* and clutches 111, 112, 113, and 114. As a result, added security for preventing unwanted tampering with padlock 20 is achieved.

In the preferred construction of this further alternate embodiment of dual mode padlock 20, key controlled locking components are also incorporated in a manner similar to the embodiments detailed above. In this regard, key activated cylinder 80 is mounted in spindle/sleeve 70 coaxially aligned therewith, as well as with rotatable dials 121, 122, 123, and 124. In addition, as previously detailed, cylinder 80 incorporates locking elements which cooperate with spindle/sleeve 70 to prevent the arcuate pivoting movement of cylinder 80 relative to spindle/sleeve 70 unless specially constructed key 200 is inserted into cylinder 80. Once key 200 is fully inserted into cylinder 80, cylinder 80 is able to arcuately pivot about its central axis relative to spindle/sleeve 70.

As shown in the drawings, in the preferred construction of this embodiment of the present invention, cylinder 80 incorporates tip 81A extending from the top surface thereof, with tip 81A comprising upstanding wall or abutment surface 82 integrally formed therewith. In addition, cam/control member 60 incorporates abutment element 64B formed in the bottom end thereof, with abutment element incorporating contact wall 64A.

In this way, once padlock 20 is fully assembled, tip 81A extends into the bottom end of cam/control member 60, causing abutment surface 82 of cylinder 80 to be in direct contact with wall 64A of cam/control member 60. Consequently, whenever the designated key 200 is inserted into cylinder 80 in order to cause cylinder 80 to arcuately pivot, cam/control member 60 is forced to arcuately rotate therewith, due to the controlling contacting engagement between contact wall 64A and abutment surface 82.

Once cam/control member 60 is arcuately pivoted, curved recesses 62 of cam/control member 60 are brought into alignment with locking bolts 50, effectively releasing locking bolts 50 from locked engagement with cutout zones 41 of shackle 40. Once locking bolts 50 have been released, spring 130 is able to force shackle 40 out of engagement with housing 30, effectively disengaging shackle 30 from its locked mode.

This embodiment further comprises cylinder housing 90, comprising slot 95. Slot 95 is placed in between groove 22 and wall 26 of padlock 20, preventing cylinder housing 90 from having rotational or vertical movement. Because cylinder housing 90 is not able to move, it further ensures that the only way to open padlock 20 using the key controlled components is to insert into cylinder 80, the correct key 200 and turn cylinder 80.

Whenever the key controlled components of padlock 20 are employed for releasing shackle 40, the combination controlled elements are not affected and remain in whatever position they had previously been placed. Similarly, whenever the combination controlled elements are employed for releasing shackle 40, the key controlled components are not affected and remain in their last position. In this regard, cam/control member 60 incorporates enlarged open zone 67 formed in the bottom end thereof which enables cam/control member 62 to be arcuately pivoted in response to the movement of spindle/sleeve 70 when employing the combination controlled components, with this arcuate pivoting movement having no interference from or effect on tip 81A and abutment surface 82 of cylinder 80. As a result, both the combination controlled section and the key controlled section of padlock 20 are able to operate completely independently of each other without interference.

In those instances when padlock 20 is employed with luggage, suitcases, and the like which require transit security personnel to unlock the padlock in order to gain access to the interior of the luggage, this further embodiment of padlock 20 is constructed for enabling the master key employed by the transit security personnel to be removed while padlock 20 is in the open position, while also allowing padlock 20 to be returned to the secure and locked position without requiring the use of the key. By employing this key non-captive system, the transit security personnel are able to achieve the desired inspection with greater ease, efficiency, and in reduced time.

In the present invention, whenever key 200 is employed to open padlock 20 and shackle 40 is disengaged from housing 30, locking bolts 50 are effectively sandwiched between arcuately curved recesses 62 of cam/control member 60 and the outer surface of either long leg 46 or short leg 45 of shackle 40. Once this position has been achieved, key 200 can be easily removed from cylinder 80 without causing any arcuate pivoting movement of cam/control member 60.

Thereafter, the open position is maintained until shackle 40 is reinserted into housing 30 causing locking bolts 50 to move into engagement with cutout zones 41 of shackle 40, while spring member 160 automatically forces cam/control member 60 to return to its locked position. In this way, transit security personnel are able to remove key 200, perform the desired inspection, and thereafter return padlock 20 into locked engagement for securing the suitcase or luggage which had been inspected.

Another feature incorporated into this further embodiment of dual mode padlock 20 is the construction of a unique reset mechanism. In this unique construction, the owner of padlock 20 possesses a master key for operating cylinder 80 while also being fully knowledgeable of the combination codes employed for operating the combination controlled section. In this way, only the owner is able to change the combination code, thereby preventing other individuals from altering the combination code without the owner's authority. As a result, by employing this construction, many individuals can possess knowledge of the combination code for allowing multiple individuals to gain access to a particular location, property, and the like, while still preventing these individuals from altering the combination code without the owner's permission.

In this embodiment, padlock 20 incorporates blocking member 150 mounted at the bottom end of spindle 70 to control the procedure for resetting the combination code. As depicted, blocking member 150 has extended-protrusions 151 which protrusions control the downward movement of button 100. As described above, button 100 is riveted to spindle 70, thereby causing the movement of button 100 to be transferred directly to spindle 70.

As a result of this construction, the normal downward movement of spindle 70 and button 100 are blocked by extended protrusions 151 of blocking member 150. However, when key 200 is inserted into cylinder 80, cylinder 80 is able to rotate about its central axis. Furthermore, end 83 of cylinder 80 is affixed to blocking member 150 by fitting end 83 into slot 152 of the blocking member 150, which causes blocking member 150 to arcuately pivot simultaneously with the arcuate pivoting movement of cylinder 80. This movement causes extended protrusions 151 of blocking member 150 to turn into alignment with gap 101 of button 100. Once gap 101 is aligned with extended protrusions 151, button 100 can be pulled downwardly with protrusions 151 passing through gap 101.

Next, the owner rotates dials 121, 122, 123, and 124 to display the predetermined combination and then pulls button 100 and spindle 70. As spindle 70 is pulled downwardly, extending fins 111*a*, 112*a*, 113*a*, and 114*a* of clutches 111, 112, 113, and 114 will disengage from teeth 121*a*, 122*a*, 123*a*, and 124*a* of dials 121, 122, 123, and 124. Although button 100 and spindle 70 are riveted together, button 100 can turn freely when button 100 is pulled out of cover 10.

As button 100 is turned, the owner can set button 100 at end 11 of cover 10. Preferably, end 11 of cover 10 has a tip 12 which contacts surface 102 of button 100, enabling button 100 to be retained in this position. Once button 100 has been turned into this position, the user is able to use both of his hands to turn dials 121, 122, 123, and 124 in order to create any desired new combination code.

By employing this construction, button 100 has a user-friendly feature which enables the owner to use both of his hands during the dial resetting mode. Currently, most prior art products require the user to use one hand to pull or push an activation button and maintain that button in the activated position while turning the dials with the user's second hand.

Once the owner has established a new combination code, button 100 is turned into its original position. Once in this position, spindle-spring 140 on spindle 70 forces spindle 70 and button 100 into their original position. As a result, spindle 70 moves back to the block mode position as spindle-spring 140 also forces clutches 111, 112, 113, and 114 to move upwardly. The extended fins 111*a*, 112*a*, 113*a*, and 114*a* of clutches 111, 112, 113, and 114 engaged with teeth 121*a*, 122*a*, 123*a*, and 124*a* of dials 121, 122, 123, and 124. Thereafter, the owner can turn cylinder 80 back to its locking position and withdraw key 200.

If desired, cylinder 80 can be constructed as a single elongated cylinder, as shown and described above, or can be constructed in two separate parts. As depicted in FIG. 62, cylinder 80 effectively comprises two separate and independent components, upper cylinder portion 300 and lower cylinder portion 310. Upper cylinder portion 300 incorporates extending tip 301 which functions in the manner detailed above in contacting in controllably moving abutment wall 64A of cam/control member 60.

In order to provide the desired controlled rotational movement, upper cylinder portion 300 incorporates a slot 302 formed on the bottom surface thereof, with standing ridge 311 formed on the upper surface of lower cylinder portion 310. By coaxially aligning upper cylinder portion 300 with lower cylinder portion 310, slot 302 engages with upstanding ridge 311 causing the arcuate pivoting movement of lower cylinder portion 310 to directly control the arcuate pivoting movement of upper cylinder portion 300. In this way, the desired rotational movement is achieved, as fully detailed above, using two separate components, with cam/control member 60 being arcuately pivoted in the substantially identical manner as detailed above.

Although the foregoing detailed disclosure describes and defines dual mode padlock 20 incorporating both a combination controlled locking section and a key control locking section, it is evident that the features of the present invention can be incorporated into a padlock which is constructed with a single locking mode. Consequently, it is to be understood that the features defined herein, both the combination controlled locking section and the key control locking section, can be employed separately in a padlock without departing from the scope of this invention.

It will thus be seen that the objects set forth above, among those made apparent from the preceding description, are efficiently obtained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of a language, might be said to fall therebetween.

Having described our invention, what we claim as new and desire to secure by Letters Patent is:

1. A padlock constructed for providing two separate and independent locking means in a single integrated construction, said padlock comprising:

(a) a housing constructed for retaining a combination controlled locking assembly and a key controlled locking assembly in cooperating, controlling relationship with a deadbolt locking member;

(b) a combination controlled locking assembly and a key controlled locking assembly mounted in the housing in coaxial, aligned relationship with each other, thereby establishing a dual mode locking construction configured and contained in a small, compact area;

(c) a shackle member mounted in the housing and movable between a first, housing engaged and locked position and a second, housing disengaged and unlocked position, each of said positions being controlled by activation of the combination controlled locking assembly or the key controlled locking assembly;

(d) said deadbolt locking member mounted in the housing in cooperating relationship with a control member and at least one end of the shackle member; and (e) the control member (i) mounted in the housing for arcuate, pivoting movement therein, (ii) positioned in cooperative association with the deadbolt locking member for controlling the movement of the deadbolt locking member between a first shackle engaged position and a second shackle released position for causing such shackle member to move between its first housing engaged and locked position and its second, housing disengaged and unlocked position, and (iii) responsive to the activation of the combination controlled locking assembly for causing the arcuate, pivoting movement thereof and the controlled movement of the deadbolt locking member with the shackle member and responsive to the activation of the key controlled locking assembly for causing the arcuate, pivoting movement thereof and the controlled movement of the deadbolt locking member with the shackle member;

whereby a padlock construction is attained which achieves a compact construction having a coaxially aligned combination controlled locking assembly and key controlled locking assembly, with both assemblies controlling the movement of said deadbolt locking member for locking and releasing a cooperating shackle member.

2. The padlock defined in claim 1, wherein the key controlled locking assembly is further defined as comprising a cylinder assembly incorporating a key receiving slot cooperatively associated with a plurality of tumblers for preventing the rotational movement of said cylinder whenever the designated key is not present and enabling rotational movement of the cylinder in response to the presence of the designated key for enabling activation of said control member, and the combination controlled locking assembly is further defined as comprising:

(i) a plurality of tumbler sleeves, each of said tumbler sleeves being rotationally mounted about the cylinder assembly of the key controlled locking assembly for rotational movement about the central axis of thereof, and (ii) a plurality of dials, each of said dials peripherally surrounding a tumbler sleeve for cooperating therewith and establishing a predesignated combination for enabling activation of said control member.

3. The padlock defined in claim 2, wherein the deadbolt locking member is further defined as being movably mounted in the housing with one portion thereof being in cooperating relationship with the shackle member and a second portion thereof being in cooperating relationship with the control member, and wherein the control member comprises a first curved recess and the shackle member is further defined as comprising a cutout zone formed in the outer surface thereof, said first curved recess being aligned with the cutout zone to enable the deadbolt locking member to move from engagement between the outer surface of the control member and the cutout zone of the shackle to disengagement from the cutout zone and engagement in the first curved recess as the control member arcuately pivots in the housing, thereby enabling the deadbolt locking member to alternately move into and out of engagement with one of said cutout zone and said first curved recess, thereby causing the shackle member to be alternately positioned in locked engagement with the housing or in unlocked, released cooperating relationship with the housing.

4. The padlock defined in claim 3, wherein the cylinder assembly comprises an upstanding finger member, axially extending from the top surface of said cylinder, with said finger being controllably engaged in the bottom end of the control member for causing the control member to arcuately pivot simultaneously with the arcuate movement of said cylinder.

5. The padlock defined in claim 4, wherein the control member is further defined as comprising cam surfaces formed on the lower end thereof constructed for cooperative following engagement with cam controlling elements and said padlock further comprising:

(f) an elongated, substantially hollow, cylindrically shaped sleeve member (i) mounted in the housing, (ii) positioned between the cylinder assembly of the key controlled locking member and the tumbler sleeves of the combination controlled locking assembly, (iii) longitudinally movable relative to the housing in response to the combination controlled locking assembly being placed in its open position, and (iv) comprising ramped, sloping, camming controlling elements formed on the upper end thereof for controllably engaging the cam surface formed on the lower end of the control member for causing control member to arcuately pivot whenever the sleeve member is axially advanced upwardly in the housing.

6. The padlock defined in claim 5, wherein said padlock further comprises a flat spring member mounted to the top surface of the control member with a first end of said flat spring member being controllably engaged with said control member and a second end of said flat spring member being affixed to the housing, whereby said flat spring member continuously exerts a rotational biasing force on the control member for attempting to cause said control member to return to its original, shackle locked position.

7. The padlock defined in claim 6, wherein said flat spring member is further defined as being formed as a continuous, spiral shaped member comprising a plurality of arcuately curved or circular shaped elements, with each successive element peripherally surrounding the previous element and having a greater diameter than the previous element.

8. The padlock defined in claim 5, wherein said padlock further comprises an enlarged activation button securely affixed to the bottom edge of the sleeve member and constructed for enabling the controlled movement of said sleeve member both vertically and rotationally.

9. The padlock defined in claim 8, wherein said padlock further comprises a cylindrically shaped blocking member mounted in the lower end of the sleeve member in cooperating relationship with the sleeve member and the activation button, with said blocking member incorporating radially extending posts formed on the outer surface thereof position for cooperating with slots formed on an inside surface of the activation button, whereby axial movement of the sleeve member is capable of being achieved only when the radially extending posts are aligned for passage through the slots of the activation button.

10. The padlock defined in claim 9, wherein said activation button further comprises a holding ledge formed on an inside surface of the activation button directly adjacent to the slots for enabling the radially extending posts of the blocking member to pass through the slots and be engaged with the holding ledge upon rotation of said activation button, whereby the hollow, cylindrically shaped sleeve member is axially movable in the housing for extending partially outwardly therefrom and pivoted into a position for being retained in the outwardly extending position whenever the pre-designated combination has been entered.

11. The padlock defined in claim 10, wherein when said sleeve member is in said position for being retained in the outwardly extending position, said pre-designated combination for enabling activation of said control member can be changed to a new combination by rotating said plurality of dials to the new combination.

12. The padlock defined in claim 5, wherein said cylinder assembly of the key controlled locking assembly further comprises an intermediate section positioned between the cylinder and the control member with a first end thereof controllably engaging the control member, and the cylinder comprises an upstanding flange formed on the cylinder end opposite the key receiving slot, and the second end of the intermediate portion comprises a slot formed therein and constructed for mating engagement with the flange of the cylinder assembly thereby causing the intermediate portion to arcuately pivot in response to the arcuate pivoting of the cylinder member whenever the designated key is inserted in the key receiving slot, thereby causing the intermediate section and the control member to move simultaneously for controllably moving the deadbolt locking member.

13. The padlock defined in claim 5, wherein said padlock further comprises a collar member mounted in the housing in contact with the bottom edge of the sleeve member, with the collar member being cooperatively associated with a coil spring for normally biasing the collar member outwardly, said collar member being further constructed for contacting the lower edge of the sleeve member whenever the collar member is pressed inwardly, causing said sleeve member to move axially in the housing in response to the pre-set combination being employed, thereby causing the shackle to be released.

14. The padlock defined in claim 5, wherein said control member is further defined as comprising a second curved recess formed in a portion thereof longitudinally and arcuately spaced from the first curved recess for providing the deadbolt locking member with two alternate positions for enabling the movement of said deadbolt locking member.

15. The padlock defined in claim 5, wherein said key controlled locking assembly is constructed to provide a non-key captive capability wherein the designated key can be removed from the cylinder assembly whenever the shackle is in its unlocked position.

16. The padlock defined in claim 3, wherein the deadbolt locking member is further defined as comprising a shape selected from the group consisting of spheres, cylinders, ovals, ellipses, and rectangles.

17. The padlock defined in claim 1, wherein said padlock comprises two separate and independent deadbolt locking members mounted in the housing with each deadbolt locking member being positioned for cooperative controlled movement with the control member and locking/unlocking interengagement with both ends of the shackle.

18. A padlock constructed for providing two separate and independent locking means in a single integrated construction, said padlock comprising:

(a) a housing constructed for retaining a combination controlled locking assembly and a key controlled locking assembly in cooperating, controlling relationship with a deadbolt locking member;

(b) a combination controlled locking assembly and a key controlled locking assembly mounted in the housing in coaxial, aligned relationship with each other, thereby establishing a dual mode locking construction configured and contained in a small, compact area;

(c) a shackle member mounted in the housing and movable between a first, housing engaged and locked position and a second, housing disengaged and unlocked position, each of said positions being controlled by activation of the combination controlled locking assembly or the key controlled locking assembly;

(d) said deadbolt locking member mounted in the housing in cooperating relationship with a control member and at least one end of the shackle member; and (e) the control member (i) mounted in the housing for arcuate, pivoting movement therein, (ii) positioned in cooperative association with the deadbolt locking member for controlling the movement of the deadbolt locking member between a first shackle engaged position and a second shackle released position for causing such shackle member to move between its first housing engaged and locked position and its second, housing disengaged and unlocked position, and (iii) responsive to the activation of the combination controlled locking assembly for causing the arcuate pivoting movement thereof and the controlled movement of the deadbolt locking member with the shackle member and responsive to the activation of the key controlled locking assembly for causing the arcuate, pivoting movement thereof and the controlled movement of the deadbolt locking member with the shackle member;

wherein said combination controlled locking assembly further comprises a plurality of dials, each of said dials peripherally surrounding a tumbler sleeve for cooperating therewith and establishing a pre-designated combination for enabling activation of said control member, and wherein said pre-designated combination can be changed to a new combination by rotating said dials to said new combination when a key is inserted into said key controlled locking assembly, whereby a padlock construction is attained which achieves a compact construction having a coaxially aligned combination controlled locking assembly and key controlled locking assembly, with both assemblies controlling the movement of said deadbolt locking member for locking and releasing a cooperating shackle member.

* * * * *